US006784615B2

(12) United States Patent
Okigawa et al.

(10) Patent No.: US 6,784,615 B2
(45) Date of Patent: Aug. 31, 2004

(54) PLASMA DISPLAY PANEL AND METHOD OF MANUFACTURING PLASMA DISPLAY PANEL

(75) Inventors: Akifumi Okigawa, Tokyo (JP); Toshihiro Yoshioka, Tokyo (JP)

(73) Assignee: NEC Corporation, Tokyo (JP)

( * ) Notice: Subject to any disclaimer, the term of this patent is extended or adjusted under 35 U.S.C. 154(b) by 63 days.

(21) Appl. No.: 10/178,248

(22) Filed: Jun. 25, 2002

(65) Prior Publication Data

US 2002/0195939 A1 Dec. 26, 2002

(30) Foreign Application Priority Data

Jun. 25, 2001 (JP) ..... 2001-191765

(51) Int. Cl.[7] ..... H01J 17/49; H01J 17/00

(52) U.S. Cl. ..... 313/584; 313/581

(58) Field of Search ..... 313/584, 581, 313/583, 631, 585, 582, 586, 593, 60, 587, 491, 493, 497; 315/169.4

(56) References Cited

U.S. PATENT DOCUMENTS 6,157,128 A * 12/2000 Namiki et al. ..... 313/581
6,195,070 B1 * 2/2001 Shinoda et al. ..... 345/60
6,411,033 B1 * 6/2002 Mori et al. ..... 313/582
6,445,120 B1 * 9/2002 Kim et al. ..... 313/491
6,489,722 B1 * 12/2002 Yoshida et al. ..... 313/582
6,492,770 B2 * 12/2002 Amemiya et al. ..... 313/586
6,495,957 B2 * 12/2002 Kurogi et al. ..... 313/584
6,513,819 B1 * 2/2003 Oliver et al. ..... 280/124.152
6,583,560 B1 * 6/2003 Amemiya ..... 313/586
6,714,175 B1 * 3/2004 Shimada et al. ..... 345/60

FOREIGN PATENT DOCUMENTS

| | | |
|---|---|---|
| JP | 8-22772 | 1/1996 |
| JP | 11-202831 | 7/1999 |
| JP | 3036496 | 2/2000 |

* cited by examiner

*Primary Examiner*—Wilson Lee
*Assistant Examiner*—Chuc Tran
(74) *Attorney, Agent, or Firm*—Young & Thompson

(57) ABSTRACT

A plasma display panel having a plurality of surface discharge electrode pairs formed in a column direction at predetermined intervals, each surface discharge electrode pair having a pair of sustaining electrodes extending in a row direction so that a discharge gap is put between the sustaining electrodes. Each sustaining electrode is made up of a transparent conductive thin film, is provided with a main electrode portion formed in stripe shapes so as to face the discharge gap and a metal film of which a width is narrower than a width of the main electrode portion, and a sub-electrode portion formed at a side opposite to the discharge gap side of the main electrode portion which corresponds. With this configuration, a high image quality and a low power consumption can be obtained.

27 Claims, 10 Drawing Sheets

PLASMA DISPLAY PANEL AND METHOD OF MANUFACTURING PLASMA DISPLAY PANEL

BACKGROUND OF THE INVENTION

1. Field of the Invention

The present invention relates to a plasma display panel used as a flat display for a television receiver, a computer, and a like, and a method of manufacturing the plasma display panel (PDP), and more particularly, relates to an AC (Alternating Current) driving surface discharge type of plasma display panel and a method of manufacturing the AC driving surface discharge type of plasma display panel.

The present application claims priority of Japanese Patent Application No. 2001-191765 filed on Jun. 25, 2001, which is hereby incorporated by reference.

2. Description of Related Art

FIG. 7 is a perspective exploded view showing a schematic structure of a conventional AC driving surface discharge type of Plasma Display Panel (hereinafter referred to as PDP) 1 in that a part of the front insulation substrate 2 is cut out. FIG. 8 is a top view showing a state in that a front insulation substrate 2 of the PDP 1 is removed. FIG. 9 is an enlarged sectional view showing a section along a line A-A' in FIG. 8. The PDP 1 is disclosed in Japanese Patent No. 3036496, Japanese Patent Application Laid-open No. Hei 11-202831, and a like.

In the PDP 1, as shown in FIG. 7 to FIG. 9, under the front insulation substrate 2, a plurality of pairs of sustaining electrodes 3*a* and sustaining electrodes 3*b* of each extending in a row direction (in a horizontal direction in FIG. 8) are arranged in a column direction (in a vertical direction in FIG. 8) at predetermined intervals so that a discharge gap 4 is put between each pair. The front insulation substrate 2 is made of soda lime glass or a like so as to have a thickness of 2 mm to 5 mm similarly to a back insulation substrate 8 which will be described later. Both of the sustaining electrode 3*a* and the sustaining electrode 3*b* are made up of transparent conductive thin films such as tin oxide, indium oxide, and ITO (Indium Tin Oxide) and form a surface discharge electrode pair 3.

A plurality of pairs of bus electrodes 5*a* and bus electrodes 5*b* are respectively formed on low surfaces of the plurality of pairs of sustaining electrodes 3*a* and sustaining electrodes 3*b* at one side of each end. The bus electrodes 5*a* and the bus electrodes 5*b* are made up of metal films such as thick films of silver, or thin films of aluminum or copper and are formed in order to make resistance values of the sustaining electrode 3*a* and the sustaining electrode 3*b* of which each electrical conductivity is low. Respective lower faces on which no sustaining electrode 3*a* and no sustaining electrode 3*b* and no bus electrode 5*a* and no bus electrode 5*b* are formed in the front insulation substrate 2 are covered by a dielectric layer 6 which is transparent. The dielectric layer 6 is made of low melting point glass of which a thickness is 10 $\mu$m to 40 $\mu$m. A protection layer 7 is formed on the lower face of the dielectric layer 6 in order to protect the dielectric layer 6 from ion impacts during discharge. The protection layer 7 is made of magnesium oxide or a like of which a secondary emission coefficient is large and of which a sputtering-resistance is good, and formed by vacuum deposition or a like so as to have a thickness of 0.5 $\mu$m to 2.0 $\mu$m.

On the other hand, a plurality of data electrodes 9 in stripe shapes extending in a column direction, namely, in a direction perpendicular to formation direction of the sustaining electrodes 3*a* and the sustaining electrodes 3*b* are formed at predetermined intervals. The data electrode 9 is made up of a silver film or a like. Respective upper faces of the data electrodes 9 and the back insulation substrate 8 on which no data electrodes 9 are formed are covered by a white dielectric layer 10. On the dielectric layer 9 except the data electrode 9, a plurality of division walls 13 for separating display cells 12 are formed in the column direction. The display cell 12 is a minimum unit for forming a display screen. In FIG. 8, an area surrounded by a dashed line indicates one of the display cells 12.

Three fluorescent layers 14R, 14G, and 14B for converting an ultraviolet ray which is generated by discharge of a discharge gas into three primary colors of red (R), green (G), and blue (B) of a visible light are formed on the upper face of the dielectric layer 8 on the data electrode 9 and on the side face of the division wall 13. The fluorescent layers 14R, 14G, and 14B are formed in order of the fluorescent layer 14R, the fluorescent layer 14G, and the fluorescent layer 14B sequentially repeatedly in the row direction. The fluorescent layers (not shown) for each converting the ultraviolet ray into a visible light of a same color are formed continuously in the column direction.

Each discharge gas space 15 is kept in each space formed by the lower face of the protection layer 7, each upper face of the fluorescent layers 14R, 14G, and 14B, and two division walls 13 adjacent to each other. The discharge gas space 15 is filled with a discharge gas such as xenon, helium, or neon, or mixed gas thereof under pressure of 20 kPa to 80 kPa. An area including the sustaining electrode 3*a* and the sustaining electrode 3*b*, the bus electrode 5*a* and the bus electrode 5*b*, the data electrode 9, the fluorescent layers 14R, 14G, and 14B and the discharge gas space 15 makes the display cell 12. When the size of the display cell 12 is 1.05 mm in the vertical direction (column direction) and 0.355 mm in the horizontal direction (row direction), the sustaining electrode 3*a* and the sustaining electrode 3*b* of which widths are 300 $\mu$m to 500 $\mu$m and of which thicknesses are 0.1 $\mu$m to 2.0 $\mu$m are made so as to have the discharge gap 4 of 50 $\mu$m to 300 $\mu$m therebetween.

Next, a method of forming the sustaining electrode 3*a* and the sustaining electrode 3*b*, and the bus electrode 5*a* and the bus electrode 5*b* included in the PDP 1 will be explained with reference to FIG. 10A to FIG. 10E. The sustaining electrode 3*a* and the sustaining electrode 3*b* are formed by a lift-off method shown in FIG. 10A to FIG. 10E. FIG. 10A to FIG. 10E are enlarged sectional views showing a side of the front insulation substrate 2 which is enlarged and is turned over up and down in a section along a line A-A' in FIG. 8. First, as shown in FIG. 10A, a photosensitive dry film 21 is laminated on the front insulation substrate 2. The photosensitive dry film 21 includes a support film (not shown) and photosensitive resin (not shown) formed on the support film. Then, as shown in FIG. 10B, the photosensitive dry film 21 is exposed and developed to pattern the dry film 21. Then, as shown in FIG. 10C, a transparent conductive thin film 22 is formed on the photosensitive dry film 21 which is patterned. Then, as shown in FIG. 10D, the sustaining electrode 3*a* and the sustaining electrode 3*b* of predetermined shapes are obtained by removing the photosensitive dry film 21. Then, as shown in FIG. 10E, after pattern printing of silver paste (not shown) is applied onto the sustaining electrode 3*a* and the sustaining electrode 3*b*, the bus electrode 5*a* and the bus electrode 5*b* of predetermined shapes are obtained by annealing (for example, keeping 560° C. for thirty minutes).

Now, an outline principle in which one display cell 12 emits in the PDP 1 will be explained. First, when a voltage signal for keeping discharge is applied to the sustaining electrode 3*a* and the sustaining electrode 3*b*, a discharge generates in the discharge gas space 15. Electrons which generate by this discharge are in collision with xenon atoms, helium atoms, neon atoms, or a like (hereunder, called only xenon atoms or a like), the xenon atoms or a like are excited or ionized. For example, excited xenon atoms generate ultraviolet rays of a vacuum ultraviolet area of 147 nm to 190 nm. The generated ultraviolet rays are irradiated to the fluorescent layer 14R, the fluorescent layer 14G, and the fluorescent layer 14B. The fluorescent layer 14R, the fluorescent layer 14G, and the fluorescent layer 14B to which the ultraviolet rays are irradiated respectively, generate a visible red light, a visible green light, and a visible blue light. The visible red light, the visible green light, and the visible blue are respectively reflected by the white dielectric layer 10, and then go out after passing through the protection layer 7, the dielectric layer 6, the sustaining electrode 3*a*, the sustaining electrode 3*b*, and the front insulation substrate 2.

On the other hand, the discharge which generates in the discharge gas space is stopped automatically, after electric charges are accumulated on a lower face of the dielectric layer 6. For example, when a positive pulse voltage is applied to the sustaining electrode 3*a* and a negative pulse voltage is applied to the sustaining electrode 3*b* as voltage signal, electrons which generate by the discharge in the discharge gas space 15 move to the sustaining electrode 3*a* and positive ions such as xenon atoms move to the sustaining electrode 3*b*. With these processes, the lower face of the dielectric layer 6 formed under the sustaining electrode 3*a* is negatively charged and the lower face of the dielectric layer 6 formed under the sustaining electrode 3*b* is positively charged, and then the charge is stopped.

Recently, concerning general displays, also concerning an AC driving surface discharge type of PDP, it is required that an image quality is high and a power consumption is low.

However, in the conventional PDP 1, when a luminance is made high by increasing the voltage to be applied the sustaining electrode 3*a* and the sustaining electrode 3*b* in order to improve the image quality, the power consumption caused by the discharge increases.

Then, to carry out a high image quality and a low power consumption, though a first technique to a third technique are considered, new problems occur as follows.

First, to reduce the power consumption of the AC driving surface discharge type of PDP, it is necessary to improve a luminous efficiency of a display cell and to reduce a power consumed by the discharge. Generally, in the AC driving surface discharge type of PDP, as a discharge current density becomes low, a luminous efficiency of ultraviolet rays becomes high. As a result, a luminous efficiency of visible light tends to become high. Then, when a voltage to be applied to a sustaining electrode is reduced and a discharge current is reduced, the discharge current density becomes low. Therefore, it is possible to make a luminous efficiency of a display cell high. However, when the voltage to be applied to the sustaining electrode is reduced, the discharge becomes unstable, and therefore, it is impossible to carry out a stable display operation.

Secondly, when widths of the sustaining electrode 3*a* and the sustaining electrode 3*b* are made narrow and areas of the sustaining electrode 3*a* and the sustaining electrode 3*b* are reduced, it is possible to reduce a capacitance between the lower face of the dielectric layer 6, and the sustaining electrode 3*a* and the sustaining electrode 3*b*. When a voltage applied to the sustaining electrode 3*a* is equal to a voltage applied to the sustaining electrode 3*b*, a charge amount accumulated on the lower face of the dielectric layer 6 reduces when the charge is stopped. Therefore, it is possible to reduce a discharge current. However, in the second technique, as described above, since the areas of the sustaining electrode 3*a* and the sustaining electrode 3*b* are reduced, the discharge current density of the display cell 12 does not change after all, and therefore, the luminous efficiency hardly changes. Also, when the areas of the sustaining electrode 3*a* and the sustaining electrode 3*b* are reduced, the charge does not diffuse in the sustaining electrode 3*a* and the sustaining electrode 3*b* over all, and therefore, only a part of the fluorescent layer 14R, the fluorescent layer 14G, and the fluorescent layer 14B emits. As a result, a luminance of the display cell 12 gets worse, and it is impossible to obtain a sufficient image quality.

Thirdly, Japanese Patent Application Laid-open No. Hei 8-22772 discloses a following technique. In this technique, a sustaining electrode made up of a transparent conductive thin film includes a main part extending in a row direction and a projection part projecting from the main part to an adjacent sustaining electrode for each display cell. Then, the projection part has a narrow small part which a width in the row direction is narrower than a width of a top end part in the row direction. In this technique, the narrow small part is provided, whereby the discharge current for one display cell is reduced so as to reduce the power consumption. As a result, the luminous efficiency is improved. However, in this technique, since the discharge concentrates near the small narrow part and does not diffuse in the display cell over all, there is a possibility in that a luminance lowers. Also, in this technique, the sustaining electrode made up of the transparent conductive thin film is patterned in a complex shape, a crack occurs in the small narrow part and there is a possibility of breaking.

SUMMARY OF THE INVENTION

In view of the above, it is an object of the present invention to provide a plasma display panel and a method of manufacturing the plasma display panel capable of providing both a high image quality and a low power consumption.

According to a first aspect of the present invention, there is provided a plasma display panel having a plurality of surface discharge electrode pairs formed in a column direction at predetermined intervals, each of the surface discharge electrode pairs having a pair of sustaining electrodes extending in a row direction so that a discharge gap is put between the sustaining electrodes, wherein:

each of the sustaining electrodes is made up of a transparent conductive thin film main electrode portion formed in stripe shapes so as to face the discharge gap and a metal film of which a width is narrower than a width of the main electrode portion that forms a sub-electrode at a side of the main electrode opposite the discharge gap.

In the foregoing, a preferable mode is one wherein the sub-electrode portion is provided with a first parallel portion extending in the row direction at a predetermined distance from the main electrode portion, and a second parallel portion extending in the row direction at a predetermined distance from the first parallel portion between the main electrode portion and the first parallel portion.

Also, a preferable mode is one wherein the sub-electrode portion is provided with a vertical portion extending to the main electrode portion at a position at which distances from adjacent division walls extending in the column direction for separating each display cell are approximately equal and integrated with the first parallel portion and the second parallel portion in a manner that an end portion of the vertical portion is electrically in contact with the main electrode portion.

Also, a preferable mode is one wherein the sub-electrode portion is provided with a first vertical portion extending to the main electrode portion at a position at which distances from adjacent division walls extending in the column direction for separating each display cell are approximately equal and integrated with the first parallel portion and the second parallel portion in a manner that an end portion of the vertical portion is electrically in contact with the main electrode portion, and a second vertical portion extending to the main electrode portion in the column direction at an upper side of the division wall and integrated with the first parallel portion and the second parallel portion in a manner that an end portion of the second vertical portion is electrically in contact with the main electrode portion.

Also, a preferable mode is one wherein a width of the second vertical portion is equal to a width of the division wall or is narrower than the width of the division wall.

Also, a preferable mode is one wherein a width of the second vertical portion is a half of a width of the division wall or less.

Also, a preferable mode is one wherein a width of the second parallel portion is 1 $\mu$m to 50 $\mu$m.

Also, a preferable mode is one wherein a width of the second parallel portion is 1 $\mu$m to 30 $\mu$m.

Also, a preferable mode is one wherein a width of the first vertical parallel portion is 1 $\mu$m to 50 $\mu$m.

Also, a preferable mode is one wherein a width of the first vertical parallel portion is 1 $\mu$m to 30 $\mu$m.

Also, a preferable mode is one wherein the main electrode portion is provided with a main electrode parallel portion extending in the row direction, and a main electrode projection part projecting from the main electrode portion at a side opposite to the discharge gap side of the main electrode portion at a position at which distances from adjacent division wall extending in the column direction to separate each display cell are approximately equal, and the first vertical portion extends to the main electrode portion in the column direction perpendicular to the first parallel portion and the second parallel portion and is integrated with the first parallel portion and the second parallel portion in a manner that an end portion of the first vertical portion is electrically in contact with the main electrode portion which corresponds.

Also, a preferable mode is one wherein lengths of the main electrode projection part in the row direction and in the column direction are 30 $\mu$m to 60 $\mu$m.

Also, a preferable mode is one wherein the sub-electrode portion is provided with a first parallel portion extending in the row direction at a predetermined distance from the main electrode portion, a first vertical portion extending to the main electrode portion in the column direction over each division wall extending in the column direction so as to separate each display cell and integrated with the first parallel portion in a manner that an end portion of the first vertical portion is electrically in contact with the main electrode portion, and a cross part including a second vertical portion extending to the main electrode portion in the column direction at a position at which distances from adjacent division walls are approximately equal and an end portion of the second vertical portion reaching near a side face of the main electrode portion, and second parallel portions respectively extending from an approximate center to the first vertical portions which are adjacent in a manner that an end portion of each of the second parallel portions reaches near the first vertical portions which are adjacent, the cross part integrated with the first vertical portion.

Also, a preferable mode is one wherein a width of the first vertical portion is equal to a width of the division wall or is narrower than a width of the division wall.

Also, a preferable mode is one wherein a width of the first vertical portion is a half of a width of the division wall or less.

Also, a preferable mode is one further including:

a bus electrode portion including a bus electrode parallel portion extending in the row direction in parallel with the first parallel portion at a distance at which there is no influence from the first parallel portion, and a bus electrode vertical portion extending to the first parallel portion in the column direction perpendicular to the first parallel portion and the bus parallel portion in a manner that an end portion of the bus electrode vertical portion is electrically in contact with the first parallel portion, and the bus electrode portion is integrated with the sub-electrode portion.

Also, a preferable mode is one wherein a width of the main electrode portion is 30 $\mu$m to 100 $\mu$m.

Also, a preferable mode is one wherein a width of the main electrode portion is 40 $\mu$m to 80 $\mu$m.

Also, a preferable mode is one wherein widths of the first parallel portion and the second parallel portion are 30 $\mu$m to 100 $\mu$m.

Also, a preferable mode is one wherein widths of the first parallel portion and the second parallel portion are 40 $\mu$m to 80 $\mu$m.

Also, a preferable mode is one wherein a width of the first parallel portion is 30 $\mu$m to 60 $\mu$m.

Furthermore, a preferable mode is one wherein both of an interval between the main electrode portion and the first parallel portion, and an interval between the second parallel portion and the first parallel portion are 30 $\mu$m to 140 $\mu$m.

According to a second aspect of the present invention, there is provided a method of manufacturing a plasma display panel according to the first aspect, a method including:

a first step of coating photosensitive silver paste on a front insulation substrate or a front insulation substrate after forming a plurality of surface discharge pair; and a second step of forming a sub-electrode portion by annealing after exposing and developing the photosensitive silver paste and patterning the photosensitive silver paste.

According to a third aspect of the present invention, there is provided a method of manufacturing a plasma display panel according to the first aspect, a method including:

a first step of coating silver paste on a front insulation substrate or a front insulation substrate after forming a plurality of surface discharge pair; and a second step of forming the sub-electrode portion by annealing after patterning the silver paste.

With this configuration, it is possible to obtain a high image quality high and to reduce power consumption.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes for carrying out the present invention will be described in further detail using embodiments with reference to the accompanying drawings.

First Embodiment

A first embodiment of the present invention will be described.

Figure 1:
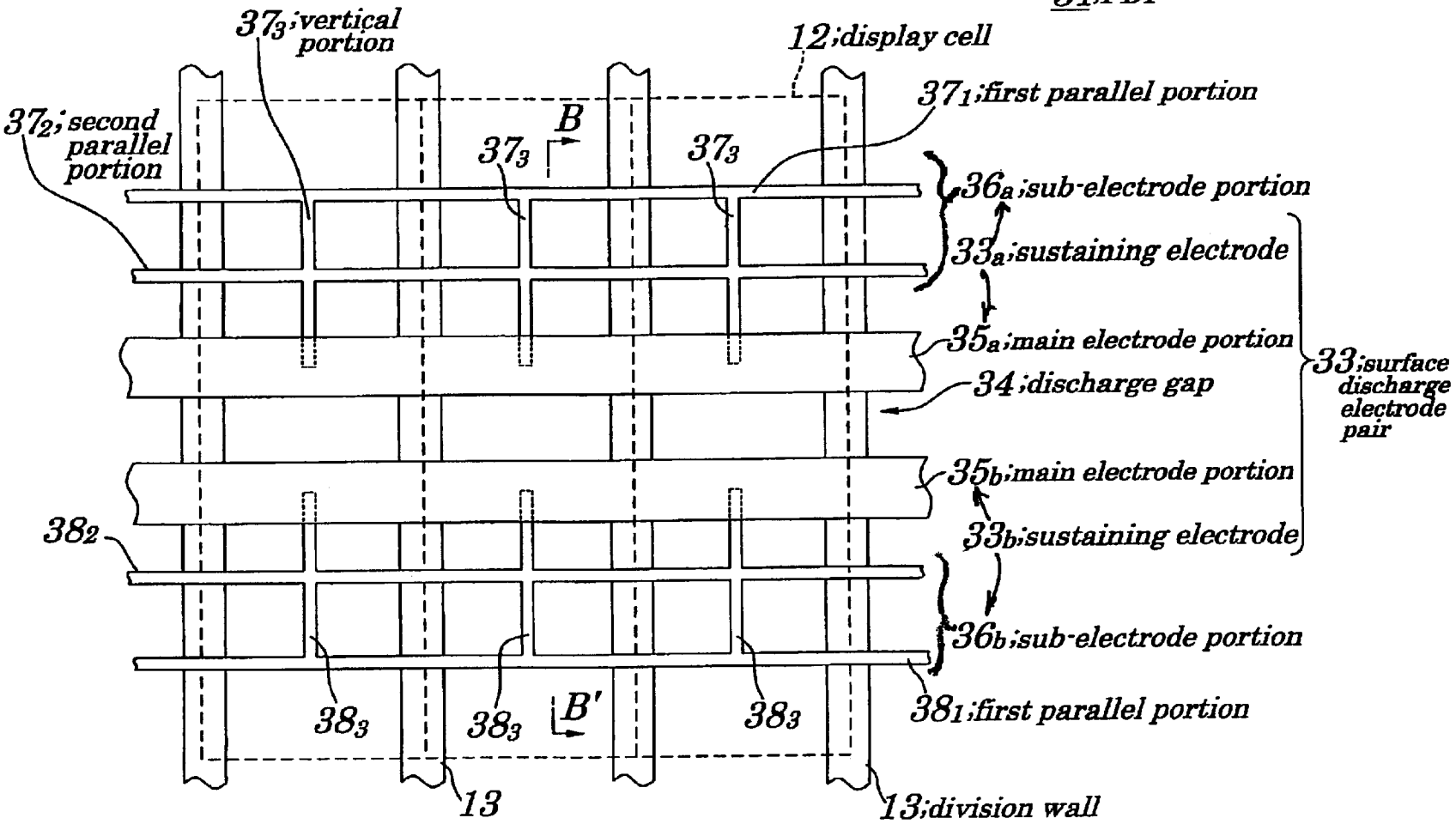
FIG. 1 is a top view showing an AC driving surface discharge type of PDP 31 in that a front insulation substrate 32 is not shown, according to a first embodiment of the present invention.

FIG. 1 is a top view showing an AC driving surface discharge type of PDP 31 in that a front insulation substrate 32 is not shown, according to a first embodiment of the present invention.

In the PDP 31, under the front insulation substrate 32, as shown in FIG. 1, a plurality of pairs of sustaining electrodes 33*a* and sustaining electrodes 33*b* extending in a row direction (in a horizontal direction in FIG. 1) as whole are alternately arranged in a column direction (in a vertical direction in FIG. 1) at predetermined intervals so that a discharge gap 34 is put between each pair. The front insulation substrate 32 (shown in FIGS. 2A–2F) is made of soda lime glass or a like so as to have a thickness of 2 mm to 5 mm. The sustaining electrode 33*a* and the sustaining electrode 33*b* form a surface discharge electrode pair 33. The sustaining electrode 33*a* includes a main electrode portion 35*a* and a sub-electrode portion 36*a*. Similarly, the sustaining electrode 33*b* includes a main electrode portion 35*b* and a sub-electrode portion 36*b*.

Both of the main electrode portion 35*a* and the main electrode portion 35*b* are made up of transparent conductive thin films in stripe shapes such as tin oxide, indium oxide, or ITO (Indium Tin Oxide). Widths of the main electrode portion 35*a* and the main electrode portion 35*b* are 30 from μm to 100 μm, preferably, from 40 μm to 80 μm.

A plurality of pairs of the sub-electrode portion 36*a* and the sub-electrode portion 36*b* are respectively formed on lower faces of the plurality of pair of the main electrode portion 35*a* and the main electrode portion 35*b* so as to correspond to the main electrode portion 35*a* and the main electrode portion 35*b*. The sub-electrode portion 36*a* is made up of metal films such as thick films of silver, or thin films of aluminum or copper and are provided with a first parallel portion $\mathbf{37}_1$, a second parallel portion $\mathbf{37}_2$, and a plurality of vertical portions $\mathbf{37}_3$ formed for respective display cells 12. The first parallel portion $\mathbf{37}_1$ is formed in parallel with the main electrode portion 35*a* at a predetermined distance from the main electrode portion 35*a* so as to extend in the row direction. The second parallel portion $\mathbf{37}_2$ is formed in parallel with the main electrode portion 35*a* at a predetermined distance from the main electrode portion 35*a* between the main electrode portion 35*a* and the first parallel portion $\mathbf{37}_1$ so as to extend in the row direction. Each vertical portion $\mathbf{37}_3$ is integrated with the first parallel portion $\mathbf{37}_1$ and the second parallel portion $\mathbf{37}_2$, and extends to the main electrode portion 35*a* in the column direction perpendicular to the first parallel portion $\mathbf{37}_1$ and the second parallel portion $\mathbf{37}_2$, and an upper face of each vertical portion $\mathbf{37}_3$ is electrically in contact with a lower face of the main electrode portion 35*a*. Each vertical portion $\mathbf{37}_3$ is formed over a position at which distances from adjacent division walls 13 in the display cell 12 in an area surrounded by a dashed line in FIG. 1 are approximately equal. Similarly, the sub-electrode portion 36*b* is made up of metal films such as thick films of silver, or thin films of aluminum or copper and are provided with a first parallel portion $\mathbf{38}_1$, a second parallel portion $\mathbf{38}_2$, and a plurality of vertical portions $\mathbf{38}_3$ formed for respective display cells 12. The sub-electrode portion 36*a* and the sub-electrode portion 36*b* are in a line-symmetric relationship in which a center axis of the discharge gap 34 is used as a symmetry line, and therefore, no detailed explanations of the sub-electrode portion 36*b* will be given.

Widths of the first parallel portion $\mathbf{37}_1$ and the first parallel portion $\mathbf{38}_1$ are preferably 30 μm to 60 μm to reduce resistance values of the main electrode portion 35*a* and the main electrode portion 35*b* of which conductivity is low. In other words, the first parallel portion $\mathbf{37}_1$ and the first parallel portion $\mathbf{38}_1$ function similarly to conventional bus electrodes. Widths of the second parallel portion $\mathbf{37}_2$ and the second parallel portion $\mathbf{38}_2$, and widths of the vertical portion $\mathbf{37}_3$ and the vertical portion $\mathbf{38}_3$ are 1 μm to 50 μm, preferably, 1 μm to 30 μm. In the first embodiment, both of an interval between the main electrode portion 35*a* and the second parallel portion $\mathbf{37}_2$, and an interval between the second parallel portion $\mathbf{37}_2$ and the first parallel portion $\mathbf{37}_1$ are 30 μm to 140 μm. Similarly, both of an interval between the main electrode portion 35*b* and the second parallel portion $\mathbf{38}_2$, and an interval between the second parallel portion $\mathbf{38}_2$ and the first parallel portion $\mathbf{38}_1$ are 30 μm to 140 μm.

Additionally, the main electrode portion 35*a* and the main electrode portion 35*b*, the sub-electrode portion 36*a* and the sub-electrode portion 36*b*, and a dielectric layer (not shown) and a protection layer (not shown) which may be sequentially formed on a lower face of the front insulation substrate 32 (shown in FIGS. 2A–2F) on which no main electrode portion 35*a* and no main electrode portion 35*b*, and no sub-electrode portion 36*a* and no sub-electrode portion 36*b* are formed are similar to those of a conventional PDP, and therefore, no explanations of those will be given. Also, a data electrode, a dielectric layer, a division wall, three kinds of fluorescent layers, and discharge gas to be filled up in a discharge gas space are similar to those of the conventional PDP, and therefore, no explanations of those will be given.

Figure 2A:
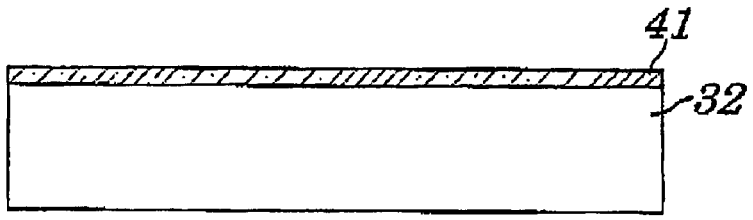
FIG. 2A to FIG. 2F are process views for explaining a forming method of a sustaining electrode 33*a* and a sustaining electrode 33*b* of the PDP 31.
Figure 2B:
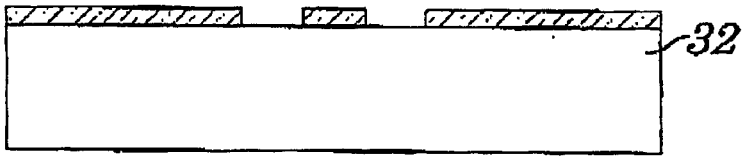

Next, a method of forming the sustaining electrode 33*a* and the sustaining electrode 33*b* included in the PDP 31 will be explained with reference to FIG. 2A to FIG. 2F. The main electrode portion 35*a* and the main electrode portion 35*b* are formed by a lift-off method shown in FIG. 2A to FIG. 2F. FIG. 2A to FIG. 2F are enlarged sectional views showing a side of the front insulation substrate 32 which is enlarged and is turned over up and down in a section along a line B-B' in FIG. 1. First, as shown in FIG. 2A, a photosensitive dry film 41 is formed on the front insulation substrate 32. The photosensitive dry film 41 includes a support film (not shown) and photosensitive resin (not shown) formed on the support film. Then, as shown in FIG. 2B, the photosensitive dry film 41 is exposed and developed to pattern the photosensitive dry film 41.

Figure 2C:
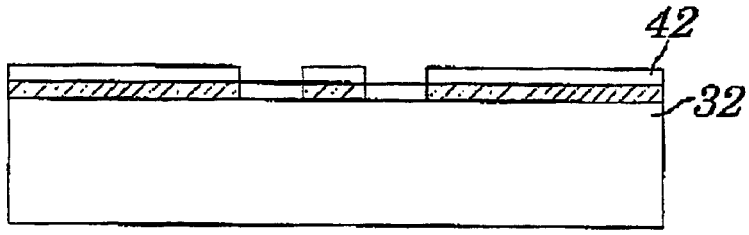
Figure 2D:
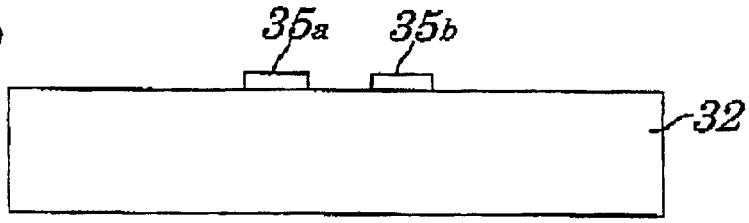
Figure 2E:
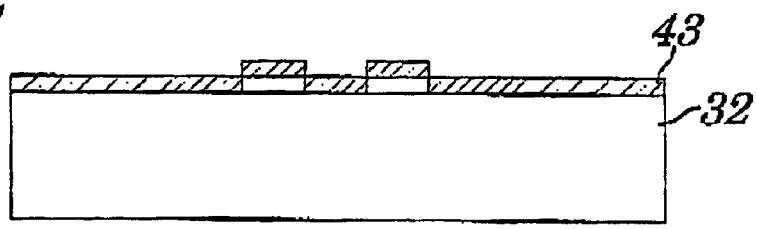
Figure 2F:
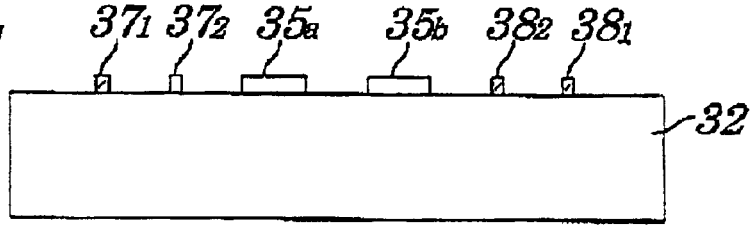

Then, as shown in FIG. 2C, a transparent conductive thin film 42 is formed on the photosensitive dry film 41 which is patterned. Then, as shown in FIG. 2D, the main electrode portion 35*a* and the main electrode portion 35*b* of predetermined shapes are obtained by removing the photosensitive dry film 41. Then, as shown in FIG. 2E, photosensitive silver paste 43 is coated on the front insulation substrate 32 with the main electrode portion 35*a* and the main electrode portion 35*b*. Then, as shown in FIG. 2F, the photosensitive silver paste 43 is exposed and developed, the photosensitive silver paste 43 is patterned, and then annealing is performed (for example, keeping at 550° C. for ten minutes), whereby the sub-electrode portion 36*a* (shown in FIG. 1) first parallel portion $\mathbf{37}_1$, the second parallel portion $\mathbf{37}_2$ and the vertical portion $\mathbf{37}_3$, and the sub-electrode portion 36*b* including the first parallel portion $\mathbf{38}_1$, the second parallel portion $\mathbf{38}_2$ and the vertical portion $\mathbf{38}_3$ are formed. Sheet resistances of the sub-electrode portion 36*a* and the sub-electrode portion 36*b* which were formed under a above-mentioned annealing condition were 3 mΩ/□ to 4 mΩ/□. Here, the vertical portion $\mathbf{37}_3$ and the vertical portion $\mathbf{37}_4$ are not shown in FIG. 2F.

As described above, according to the first embodiment, since the main electrode portion 35*a* and the main electrode portion 35*b* in stripe shapes are formed so as to extend in the row direction at both sides of the discharge gap 34, discharge becomes stable and a discharge voltage can be reduced. Also, since the main electrode portion 35*a* and the main electrode portion 35*b* are made from transparent conductive thin films, a strong light near the discharge gap 34 can pass through, and a high luminance display can be obtained. According to an experiment, widths of the main electrode portion 35*a* and the main electrode portion 35*b* were set to 30 μm to 100 μm, a high luminance display was obtained with stability of the discharge, Particularly, when the widths of the main electrode portion 35*a* and the main electrode portion 35*b* were set to 40 μm to 80 μm, it was possible to reduce the discharge voltage and to obtain a high luminance display.

Also, the second parallel portion $\mathbf{37}_2$ and the vertical portion $\mathbf{37}_3$ are formed between the main electrode portion 35*a* and the first parallel portion $\mathbf{37}_1$, and the second parallel portion $\mathbf{38}_2$ and the vertical portion $\mathbf{38}_3$ are formed between the main electrode portion 35*b* and the first parallel portion $\mathbf{38}_1$. The second parallel portion $\mathbf{37}_2$ and the second parallel portion $\mathbf{38}_2$, and the vertical portion $\mathbf{37}_3$ and the vertical portion $\mathbf{38}_3$ are made up of metal films and have a thickness of 1 μm to 50 μm. Therefore, according to the structure in the first embodiment, improvement of 10% to 40% of the luminous efficiency of the display cell 12 is caused by the following reasons.

As described above, generally, in an AC driving surface discharge type of PDP, as discharge current density is low, the luminous efficiency of the ultraviolet rays is high. As a result, the luminous efficiency of the visible light tends to be high. In the first embodiment, the widths of the second parallel portion $\mathbf{37}_2$ and the second parallel portion $\mathbf{38}_2$, and the widths of the vertical portion $\mathbf{37}_3$ and the vertical portion $\mathbf{38}_3$, are set to 1 μm to 50 μm, and an aperture is provided for each area between electrode portions forming the sub-electrode portion 36*a* and the sub-electrode portion 36*b*, whereby the discharge current density is controlled so as not to be high in those areas. As described above, the discharge current density is controlled, and this may be the reason why that the luminous efficiency of the display cell 12 can be improved. The metal film intercepts the visible light, whereas widths of the second parallel portion $\mathbf{37}_2$ and the second parallel portion $\mathbf{38}_2$, and the widths of the vertical portion $\mathbf{37}_3$ and the vertical portion $\mathbf{38}_3$ are 1 μm to 50 μm. Then, an amount of intercepted visible light is extremely smaller than the whole amount of visible light, and therefore, it does not achieve an amount to influence on the luminance.

According to an experiment, when the widths of the second parallel portion $\mathbf{37}_2$ and the second parallel portion $\mathbf{38}_2$, and the width of the vertical portion $\mathbf{37}_3$ and the vertical portion $\mathbf{38}_3$ were set to 1 μm to 30 μm, a high luminance display could be obtained. Also, in the structure of the first embodiment, as the voltage to be applied to the sustaining electrode 33*a* and the sustaining electrode 33*b* is not reduced, there does not occur danger that the discharge described as the first problem in Description of Related Art becomes unstable and a stable display operation cannot be performed.

Also, according to the structure of the first embodiment, the second parallel portion $\mathbf{37}_2$ and the second parallel portion $\mathbf{38}_2$, and the vertical portion $\mathbf{37}_3$ and the vertical portion $\mathbf{38}_3$ are provided, and the widths of them are set to 1 μm to 50 μm. Also, there is no case in that areas of the main electrode portion 35*a* and the main electrode portion 35*b* are reduced, the shapes of the main electrode portion 35*a* and the main electrode portion 35*b* are stripes, and no projection part disclosed in Japanese Patent Application Laid-open No. Hei 8-22772 is provided. According to this structure, the discharge current density is controlled, and the discharge diffuses all over the sustaining electrode 33*a* and the sustaining electrode 33*b*. With this structure, since it is possible to excite all of a fluorescent layer 14R, the fluorescent layer 14G, and a fluorescent layer 14B by ultraviolet rays, a luminance of the display cell 12 becomes higher, and a sufficient image quality can be obtained.

Therefore, according to the structure of the first embodiment, it is possible to make a higher image quality and to reduce the consumption power.

Also, according to the structure of the first embodiment, the photosensitive silver paste 43 is exposed and developed, and is patterned, and then, annealing is performed. Then, the sub-electrode portion 36*a* including the first parallel portion $\mathbf{37}_1$, the second parallel portion $\mathbf{37}_2$, and the vertical portion $\mathbf{37}_3$, and the sub-electrode portion 36*b* including the first parallel portion $\mathbf{38}_1$, the second parallel portion $\mathbf{38}_2$, and the vertical portion $\mathbf{38}_3$, which require a high patterning accuracy, are formed. Therefore, in comparison with the conventional technique in which the solution in the exposure is influenced by a thickness of a film, and the transparent conductive film is patterned by using a photosensitive dry film having an insufficient patterning accuracy, it is possible to form the sub-electrode 36*a* and the sub-electrode 36*b* easily with a good patterning accuracy.

On the other hand, according to the structure of the first embodiment, the main electrode portion 35*a* and the main electrode portion 35*b* are patterned by using a photosensitive dry film of which a process cost is cheaper. However, since the widths of the main electrode portion 35*a* and the main electrode portion 35*b* are 30 μm to 100 μm, a patterning accuracy is rougher than that of the sub-electrode 36*a* and the sub-electrode 36*b*, and therefore, it is possible to pattern the main electrode portion 35*a* and the main electrode portion 35*b* cheaply and easily.

Also, according to the structure of the first embodiment, since the sub-electrode portion 36*a* and the sub-electrode portion 36*b* are made from a metal film, it is hard to occur a crack at a joint point of the main electrode portion 35*a* and the vertical portion $\mathbf{37}_3$ or at an intersection of the first parallel portion $\mathbf{37}_1$ and the vertical portion $\mathbf{37}_3$ and it is hard to break a wire.

Second Embodiment

A second embodiment of the present invention will be described.

Figure 3:
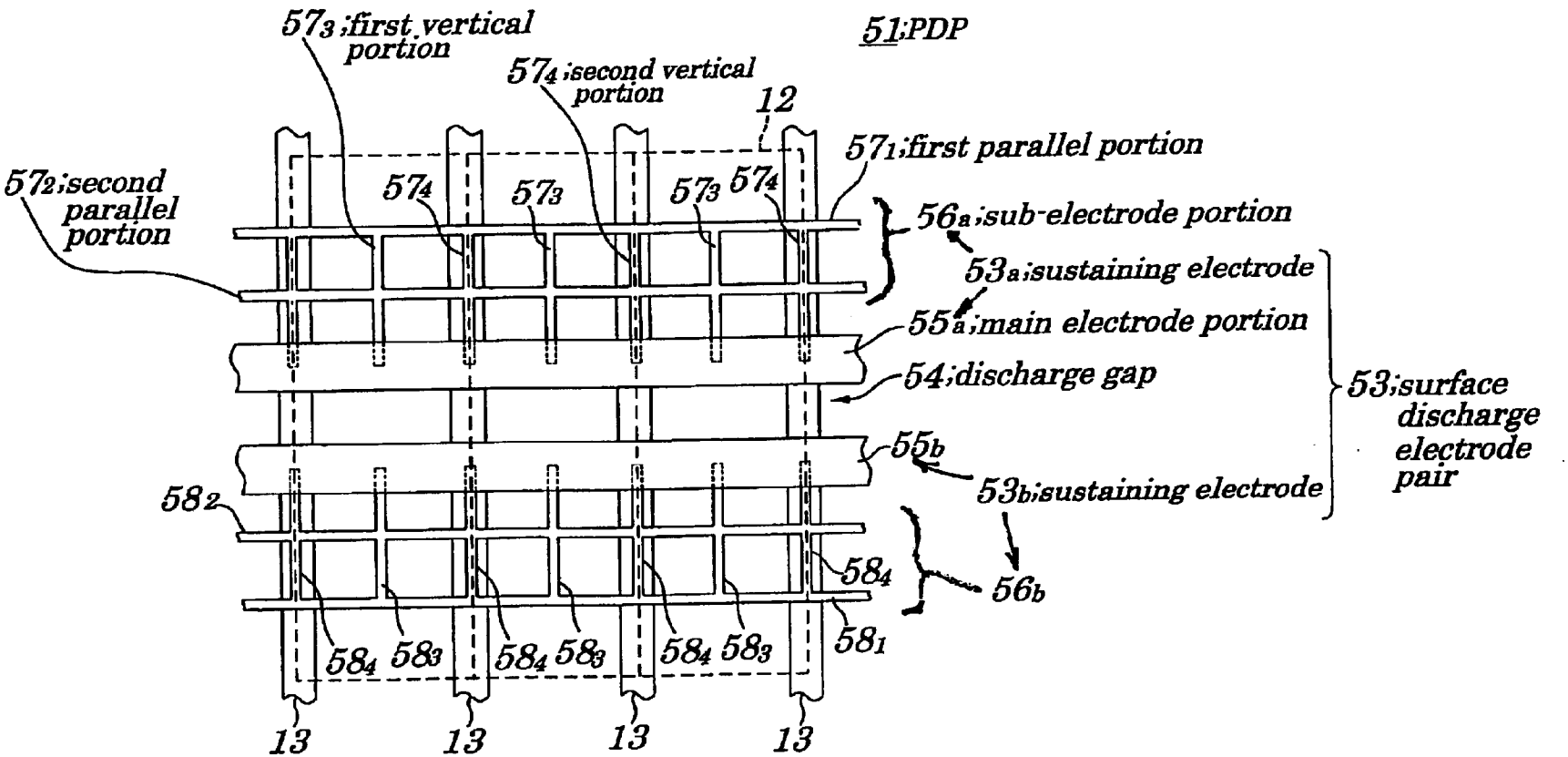
FIG. 3 is a top view showing an AC driving surface discharge type of PDP 51 in that a front insulation substrate 52 is not shown, according to a second embodiment of the present invention.

FIG. 3 is a top view showing an AC driving surface discharge type of PDP 51 in that a front insulation substrate 52 is not shown, according to a second embodiment of the present invention.

In the PDP 51, under the front insulation substrate 52 (not shown), as shown in FIG. 3, a plurality of pairs of sustaining electrodes 53*a* and sustaining electrodes 53*b* extending in a row direction (in a horizontal direction in FIG. 3) as whole are alternately arranged in a column direction (in a vertical direction in FIG. 3) at predetermined intervals so that a discharge gap 54 is put between each pair. The front insulation substrate 52 is made of soda lime glass or a like so as to have a thickness of 2 mm to 5 mm. The sustaining electrode 53*a* and the sustaining electrode 53*b* form a surface discharge electrode pair 53. The sustaining electrode 53*a* includes a main electrode portion 55*a* and a sub-electrode portion 56*a*. Similarly, the sustaining electrode 53*b* includes a main electrode portion 55*b* and a sub-electrode portion 56*b*.

Both of the main electrode portion 55*a* and the main electrode portion 55*b* are made up of transparent conductive thin films in stripe shapes such as tin oxide, indium oxide, or ITO (Indium Tin Oxide). Widths of the main electrode portion 55*a* and the main electrode portion 55*b* are 30 μm to 100 μm, preferably 40 μm to 80 μm.

A plurality of pairs of the sub-electrode portion 56*a* and the sub-electrode portion 56*b* are respectively formed on lower faces of the plurality of pairs of the main electrode portion 55*a* and the main electrode portion 55*b* so as to correspond the main electrode portion 55*a* and the main electrode portion 55*b*. The main electrode portion 55*a* is made up of metal films such as thick films of silver, or thin films of aluminum or copper and are provided with a first parallel portion $\mathbf{57}_1$, a second parallel portion $\mathbf{57}_2$, a plurality of first vertical portions $\mathbf{57}_3$ formed for respective display cells 12, and a plurality of second vertical portions $\mathbf{57}_4$ provided over a division wall 13. The first parallel portion $\mathbf{57}_1$ is formed in parallel with the main electrode portion 55*a* at a predetermined distance from the main electrode portion 55*a* so as to extend in the row direction. The second parallel portion $\mathbf{57}_2$ is formed in parallel with the main electrode portion 55*a* at a predetermined distance from the main electrode 55*a* between the main electrode portion 55*a* and the first parallel portion $\mathbf{57}_1$ so as to extend in the row direction. Each first vertical portion $\mathbf{57}_3$ is integrated with the first parallel portion $\mathbf{57}_1$ and the second parallel portion $\mathbf{57}_2$, and extends to the main electrode portion 55*a* in the column direction perpendicular to the first parallel portion $\mathbf{57}_1$ and the second parallel portion $\mathbf{57}_2$, and an upper face of each first vertical portion $\mathbf{57}_3$ is electrically in contact with a lower face of the main electrode portion 55*a*. Each first vertical portion $\mathbf{57}_3$ is formed over a position at which distances from an adjacent division wall 13 in the display cell 12 in an area surrounded by a dashed line in FIG. 3 are approximately equal Each second vertical portion $\mathbf{57}_4$ is integrated with the first parallel portion $\mathbf{57}_1$ and the second parallel portion $\mathbf{57}_2$, and extends to the main electrode portion 55*a* in the column direction perpendicular to the first parallel portion $\mathbf{57}_1$ and the second parallel portion $\mathbf{57}_2$, and an upper face of an end portion of each second vertical portion $\mathbf{57}_4$ is electrically in contact with a lower face of the main electrode portion 55*a*. Also, each second vertical portion $\mathbf{57}_4$ is formed over the division wall 13 with a length approximately similar to that of the first vertical portion $\mathbf{57}_3$ which is adjacent. Similarly, the sub-electrode portion 56*b* is made up of metal films such as thick films of silver, or thin films of aluminum or copper and are provided with a first parallel portion $\mathbf{58}_1$, a second parallel portion $\mathbf{58}_2$, a plurality of first vertical portions $\mathbf{58}_3$ formed for respective display cells 12, and a plurality of second vertical portions $\mathbf{58}_4$ provided over the division wall 13. The sub-electrode portion 56*a* and the sub-electrode portion 56*b* are in a line-ymmetric relationship in which a center axis of the discharge gap 54 is used as a symmetry line, and therefore, no detailed explanations of the sub-electrode portion 56*b* will given.

Widths of the first parallel portion $\mathbf{58}_1$ and the second parallel portion $\mathbf{58}_2$ are preferably 30 μm to 60 μm to reduce resistance values of the main electrode portion 55*a* and the main electrode portion 55*b* of which each conductivity is low. In other words, the first parallel portion $\mathbf{57}_1$ and the first parallel portion $\mathbf{58}_1$ function similarly to conventional bus electrodes. Widths of the second parallel portion $\mathbf{57}_2$ and the second parallel portion $\mathbf{58}_2$, widths of the first vertical portion $\mathbf{57}_3$ and the first vertical portion $\mathbf{58}_3$, and widths of the second vertical portion $\mathbf{57}_4$ and the second vertical portion $\mathbf{58}_4$ are 1 μm to 50 μm, preferably, 1 μm to 30 μm. In the second embodiment, both of an interval between the main electrode portion 55*a* and the second parallel portion $\mathbf{57}_2$, and an interval between the second parallel portion $\mathbf{57}_2$ and the first parallel portion $\mathbf{57}_1$ are 30 μm to 140 μm, Similarly, both of an interval between the main electrode portion 55*b* and the second parallel portion $\mathbf{58}_2$, and an interval between the second parallel portion $\mathbf{58}_2$ and the first parallel portion $\mathbf{58}_1$ are 30 μm to 140 μm. It is preferable that the widths of the second vertical portion $\mathbf{57}_4$ and the second vertical portion $\mathbf{58}_4$ are equal to a width of the division wall 13 or narrower than the width of the division wall 13 from a point of the luminous efficiency and the luminance.

Additionally, the main electrode portion 55*a* and the main electrode portion 55*b*, the sub-electrode portion 56*a* and the sub-electrode portion 56*b*, and a dielectric layer (not shown) and a protection layer (not shown) which may be sequentially formed on a lower face of the front insulation substrate 52 (not shown) on which no main electrode portion 55*a* and no main electrode portion 55*b*, and no sub-electrode portion 55*a* and no sub-electrode portion 56*b* are formed are similar to those of a conventional PDP, and therefore, no explanations of those will be given. Also, a data electrode, a dielectric layer, a division wall, and three kinds of fluorescent layers (all not shown) which are sequentially formed on the back insulation substrate, and discharge gas to be filled up in a discharge gas space are similar to those of the conventional PDP, and therefore, no explanations of those will be given. Also, a method of forming the sustaining electrode 53*a* and the sustaining electrode 53*b* included in the PDP 51 is approximately similar to that of the first embodiment except that a pattern shape in patterning of a photosensitive silver paste 43 (not shown) since shapes of the sub-electrode portion 56*a* and the sub-electrode portion 56*b* are different from those of a sub-electrode portion 36*a* and a sub-electrode portion 36*b*. Therefore, no explanations of the method will be given.

As described above, with the second embodiment, the second vertical portion $\mathbf{57}_4$ and the second vertical portion $\mathbf{58}_4$ are over the division wall 13. In addition to the effects obtained by the first embodiment, the following effects can be obtained. Since the second vertical portion $\mathbf{57}_4$ and the second vertical portion $\mathbf{58}_4$ are over the division wall 13, the discharge diffuses near the division wall 13, xenon atoms or a like excited by the discharge generate ultraviolet rays, the generated ultraviolet rays are irradiated to side walls (not shown) of the division wall 13 and to a fluorescent layer 14R, a fluorescent layer 14G, and a fluorescent layer 14B (all not shown) which are formed near the side walls. With this structure, it is possible to make the luminance of the display cell 12 higher than that of the first embodiment.

As described above, from points of luminous efficiency and luminance, it is preferable that the widths of the second vertical portion $\mathbf{57}_4$ and the second vertical portion $\mathbf{58}_4$ are equal to that of the division wall 13 or narrower. The width of the division wall 13 varies at a bottom and a top. Here, the width of the division wall 13 indicates the top width of the division wall 13. Hereunder, the width of the division wall 13 also indicates the top width.

On the other hand, from points of manufacturing, it is preferable that the widths of the second vertical portion $\mathbf{57}_4$ and the second vertical portion $\mathbf{58}_4$ are a half of that of the division wall 13 or less. The reasons will be described. Distortions generate in the front insulation substrate (not shown) and the back insulation substrate (not shown) in a annealing process after forming the sustaining electrode 53*a* and the sustaining electrode 53*b*. Therefore, when the front insulation substrate and the back insulation substrate are put together, there is a possibility in that a positional relationship between the front insulation substrate and the back insulation substrate displaces. When a displacement occurs, and the second vertical portion $\mathbf{57}_4$ and the second vertical portion $\mathbf{58}_4$ are formed not over the division wall 13 though the second vertical portion $\mathbf{57}_4$ and the second vertical portion $\mathbf{58}_4$ must be formed over the division wall 13, the discharge state changes, and a characteristic changes for every PDP 51. Also, in a case of the displacement, when a strong discharge generates near the division wall 13, the xenon atoms or a like excited by the discharge do not generate ultraviolet rays efficiently, and therefore, the luminous efficiency lowers. Then, the widths of the second vertical portion $\mathbf{57}_4$ and the second vertical portion $\mathbf{58}_4$ are a half of the division wall 13 or less. Therefore, though a displacement of the front insulation substrate and the back insulation substrate occurs, there is no case in that the the widths of the second vertical portion $\mathbf{57}_4$ and the second vertical portion $\mathbf{58}_4$ displace from the division wall 13 if only the displacement is in the half of the division wall 13 in the row direction. With this structure, it is possible to reduce the influences caused by the displacement.

Third Embodiment

A third embodiment of the present invention will be described.

Figure 4:
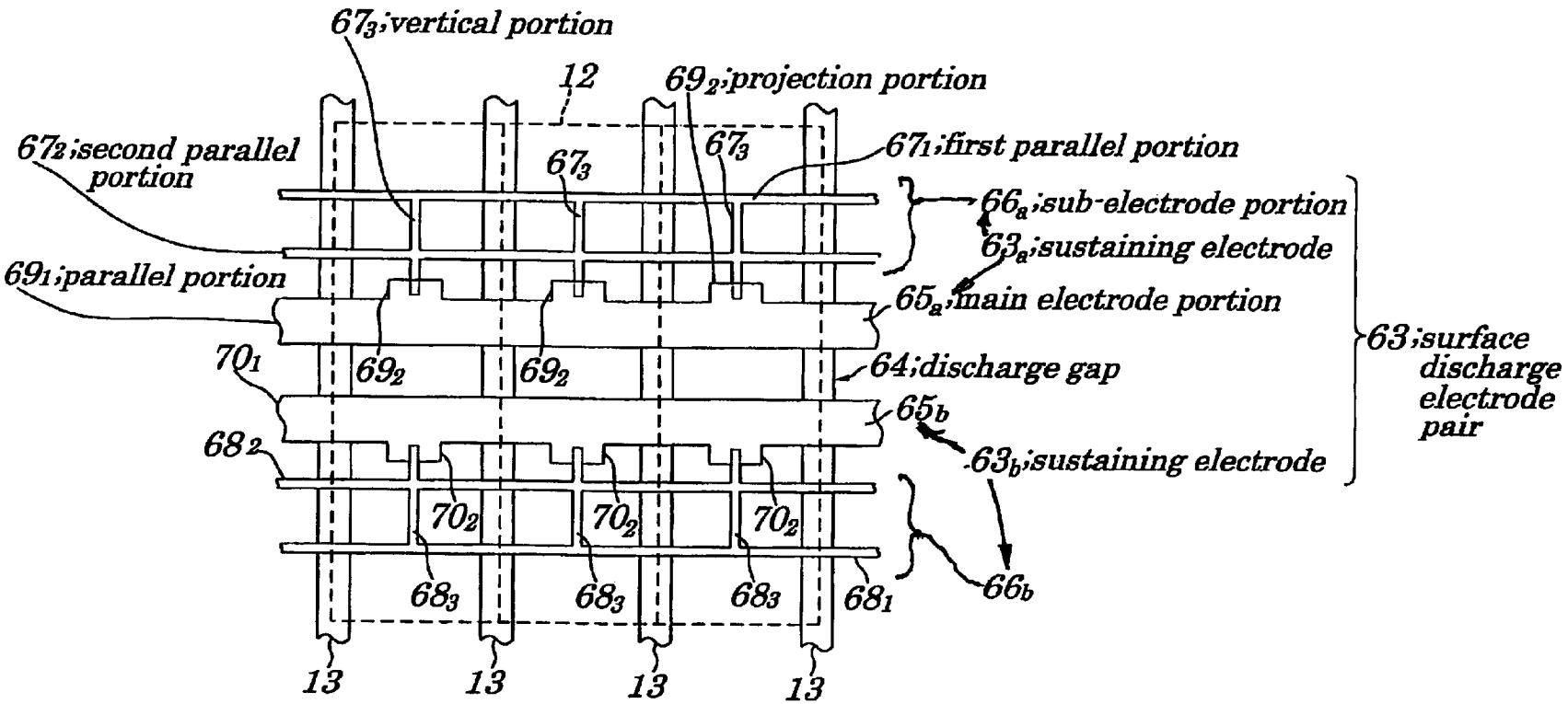
FIG. 4 is a top view showing an AC driving surface discharge type of PDP 61 in that a front insulation substrate 62 is not shown, according to a third embodiment of the present invention.

FIG. 4 is a top view showing an AC driving surface discharge type of PDP 61 in that a front insulation substrate 62 is not shown, according to a third embodiment of the present invention.

In the PDP 61, under the front insulation substrate 62 (not shown), as shown in FIG. 4, a plurality of pairs of sustaining electrodes 63*a* and sustaining electrodes 63*b* extending in a row direction (in a horizontal direction in FIG. 4) as whole are alternately arranged in a column direction (in a vertical direction in FIG. 4) at predetermined intervals so that a discharge gap 64 is put between each pair. The front insulation substrate 62 is made of soda lime glass or a like so as to have a thickness of 2 mm to 5 mm. The sustaining electrode 63*a* and the sustaining electrode 63*b* form a surface discharge electrode pair 63. The sustaining electrode 63*a* includes a main electrode portion 65*a* and a sub-electrode portion 66*a*. Similarly, the sustaining electrode 63*b* includes a main electrode portion 65*b* and a sub-electrode portion 66*b*.

Both of the main electrode portion 65*a* and the main electrode portion 65*b* are made up of transparent conductive thin films in stripe shapes such as tin oxide, indium oxide, or ITO (Indium Tin Oxide). The main electrode portion 65*a* includes a parallel portion $\mathbf{69}_1$, and projection parts $\mathbf{69}_2$, and the main electrode portion 65*b* includes a parallel portion $\mathbf{70}_1$, and projection parts $\mathbf{70}_2$. The parallel portion $\mathbf{69}_1$ and the parallel portion $\mathbf{70}_1$ are formed so as to extend in the row direction, and widths of the parallel portion $\mathbf{69}_1$ and the parallel portion $\mathbf{70}_1$ are 30 $\mu$m to 100 $\mu$m, preferably, 40 $\mu$m to 80 $\mu$m. The projection parts $\mathbf{69}_2$ are formed at an upper position at which distances from adjacent division walls 13 in the display cell 12 shown as a area surrounded by a dashed line in FIG. 4 are approximately equal and are formed so as to project from the parallel portion $\mathbf{69}_1$ at a side opposite to a side facing the discharge gap 64. Similarly, the projection parts $\mathbf{70}_2$ are formed at an upper position at which distances from adjacent division walls 13 in the display cell 12 shown as a area surrounded by a dashed line in FIG. 4 are approximately equal and is formed so as to project from the parallel portion $\mathbf{70}_1$ at a side opposite to a side facing the discharge gap 64. As to shapes of the projection parts $\mathbf{69}_2$ and the projection parts $\mathbf{70}_2$, both lengths in the row direction and in the column direction are set to 30 $\mu$m to 60 $\mu$m, for example, 50 $\mu$m. Under this condition, it is possible to obtain sufficient electrical contact of the projection parts $\mathbf{69}_2$ and the projection parts $\mathbf{70}_2$, and a vertical portion $\mathbf{68}_3$ and the vertical portion $\mathbf{70}_3$ which will be described. Additionally, though the main electrode portion 65*a* and the main electrode portion 65*b* are provided with the projection parts $\mathbf{69}_2$ and the projection parts $\mathbf{70}_2$, it is possible to obtain a yield equal to the first embodiment in which a main substrate 35*a* (shown in FIG. 1) and a main substrate 35*b* (shown in FIG. 1) stripe shapes are patterned.

A plurality of pairs of the sub-electrode portion 66*a* and the sub-electrode portion 66*b* are respectively formed on lower faces of the plurality of pairs of the main electrode portions 65*a* and the main electrode portions 65*b* so as to correspond the main electrode portions 65*a* and the main electrode portions 65*b*. The sub-electrode portion 66*a* is made up of metal films such as thick films of silver, or thin films of aluminum or copper and are provided with a first parallel portion $\mathbf{67}_1$, a second parallel portion $\mathbf{67}_2$, and a plurality of vertical portions $\mathbf{67}_3$ formed for respective display cells 12. The first parallel portion $\mathbf{67}_1$ is formed in parallel with the main electrode portion 65*a* at a predetermined distance from the main electrode portion 65*a* so as to extend in the row direction. The second parallel portion $\mathbf{67}_2$ is formed in parallel with the main electrode portion 65*a* at a predetermined distance from the main electrode portion 65*a* between the main electrode portion 65*a* and the first parallel portion $\mathbf{67}_1$ so as to extend in the row direction. Each vertical portion $\mathbf{67}_3$ is integrated with the first parallel portion $\mathbf{67}_1$ and the second parallel portion $\mathbf{67}_2$, and extends to the main electrode portion 65*a* in the column direction perpendicular to the first parallel portion $\mathbf{67}_1$ and the second parallel portion $\mathbf{67}_2$, and an upper face of an end portion of each vertical portion $\mathbf{67}_3$ is electrically in contact with a lower face of the projection part $\mathbf{69}_2$. Each vertical portion $\mathbf{67}_3$ is formed over a position at which distances from adjacent division wall 13 in the display cell 12 in an area surrounded by a dashed line in FIG. 4 are approximately equal. Similarly, the sub-electrode portion 66*b* is made up of metal films such as thick films of silver, or thin films of aluminum or copper and are provided with a first parallel portion $\mathbf{68}_1$, a second parallel portion $\mathbf{68}_2$, and the plurality of vertical portions $\mathbf{68}_3$ formed for respective display cells 12. The sub-electrode portion 66*a* and the sub-electrode portion 66*b* are in a line-ymmetric relationship in which a center axis of the discharge gap 64 is used as a symmetry line, and therefore, no detailed explanations of the sub-electrode portion 66*a* will given.

Widths of the first parallel portion $\mathbf{67}_1$ and the first parallel portion $\mathbf{68}_2$ are preferably 30 $\mu$m to 60 $\mu$m to reduce resistance values of the main electrode portion 65*a* and the main electrode portion 65*b* of which conductivity is low. In other words, the first parallel portion $\mathbf{67}_1$ and the first parallel portion $\mathbf{68}_1$ function similarly to conventional bus electrodes. Widths of the second parallel portion $\mathbf{67}_2$ and the second parallel portion $\mathbf{68}_2$, and widths of the vertical portion $\mathbf{67}_3$ and the vertical portion $\mathbf{68}_3$ are 1 $\mu$m to 50 $\mu$m, preferably, 1 $\mu$m to 30 $\mu$m. In the third embodiment, both of an interval between the parallel portion $\mathbf{69}_1$ of the main electrode portion 65*a* and the second parallel portion $\mathbf{67}_2$, and an interval between the second parallel portion $\mathbf{67}_2$ and the first parallel portion $\mathbf{67}_1$ are 30 $\mu$m to 140 $\mu$m. Similarly, both of an interval between the parallel portion $\mathbf{70}_1$ of the main electrode portion 65*b* and the second parallel portion $\mathbf{68}_2$ and an interval between the second parallel portion $\mathbf{68}_2$ and the first parallel portion $\mathbf{68}_1$ are 30 $\mu$m to 140 $\mu$m.

Additionally, the main electrode portion 65*a* and the main electrode portion 65*b*, the sub-electrode portion 66*a* and the sub-electrode portion 66*b*, and a dielectric layer (not shown) and a protection layer (not shown) which may be sequentially formed on a lower face of the front insulation substrate 62 (not shown) on which no main electrode portion 65*a* and no main electrode portion 65*b*, and no sub-electrode portion 66*a* and no sub-electrode portion 66*b* are formed are similar to those of the conventional PDP, and therefore, no explanations of those will be given. Also, a data electrode, a dielectric layer, a division wall, and three kinds of fluorescent layers (all not shown) which are sequentially formed on the back insulation substrate, and discharge gas to be filled up in a discharge gas space are similar to those of the conventional PDP, and therefore, no explanations of those will be given. Also, a method of forming the sustaining electrode 63*a* and the sustaining electrode 63*b* included in the PDP 61 is approximately similar to that of the first embodiment except that a pattern shape in patterning of a photosensitive dry film 41 (shown in FIG. 2A) and a photosensitive silver paste 43 (shown in FIG. 2E) since shapes of the main electrode portion 65*a* and the main electrode 65*b*, and the sub-electrode portion 66*a* and the sub-electrode portion 66*b* are different from those of a main electrode portion 35*a* (shown in FIG. 1) and a main electrode portion 35*b* (shown in FIG. 1) and a sub-electrode portion 36*a* (shown in FIG. 1) and a sub-electrode portion 36*b* (shown in FIG. 1). Therefore, no explanations of the method will be given.

As described above, with the third embodiment, the main electrode portion 65*a* is provided with a projection part $\mathbf{69}_2$, and each top of the vertical portion $\mathbf{67}_3$ forming the sub-electrode portion 66*a* made from the metal film is electrically in contact with only the lower face of the corresponding projection part $\mathbf{69}_2$. Similarly, the main electrode portion 65*b* is provided with the projection part $\mathbf{70}_2$, and each top of the vertical portion $\mathbf{68}_3$ forming the sub-electrode portion 66*b* made from the metal film is electrically in contact with only the lower face of the corresponding projection part $\mathbf{70}_2$. Therefore, according to the structure of the third embodiment, since it is possible to reduce an area of the metal film which is not transparent and intercepts visible light, it is possible to make luminance higher and to improve luminous efficiency in comparison with the first embodiment.

Fourth Embodiment

A fourth embodiment of the present invention will be described.

Figure 5:
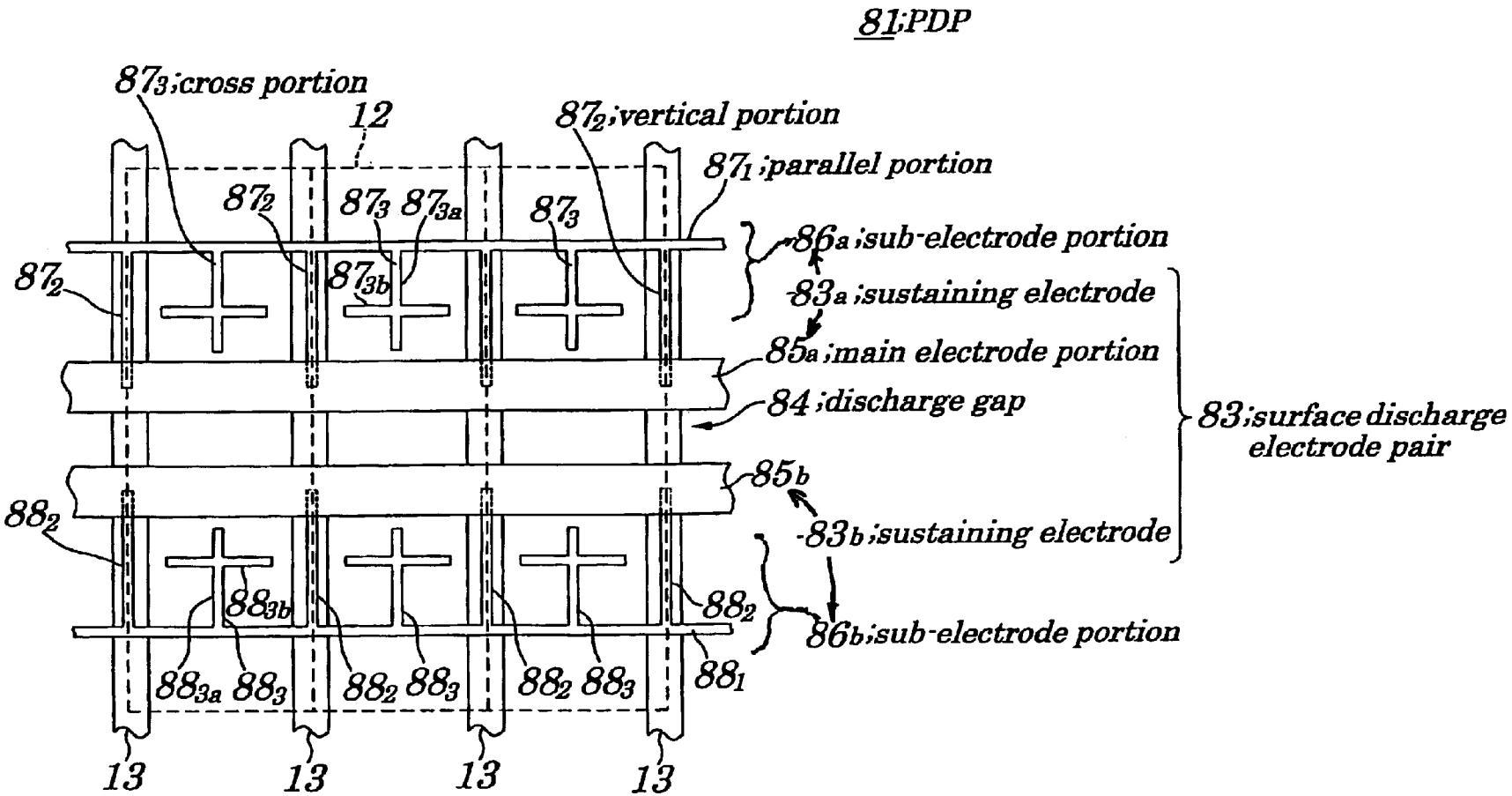
FIG. 5 is a top view showing an AC driving surface discharge type of PDP 81 in that a front insulation substrate 82 is not shown according to a fourth embodiment of the present invention.

FIG. 5 is a top view showing an AC driving surface discharge type of PDP 81 in that a front insulation substrate 82 is not shown according to a fourth embodiment of the present invention.

In the PDP 81, under the front insulation substrate 82 (not shown), as shown in FIG. 5, a plurality of pairs of sustaining electrodes 83*a* and sustaining electrodes 83*b* extending in a row direction (in a horizontal direction in FIG. 5) as whole are alternately arranged in a column direction (in a vertical direction in FIG. 5) at predetermined intervals so that a discharge gap 84 is put between each pair. The front insulation substrate 82 is made of soda lime glass or a like so as to have a thickness of 2 mm to 5 mm. The sustaining electrode 83*a* and the sustaining electrode 83*b* form a surface discharge electrode pair 83. The sustaining electrode 83*a* includes a main electrode portion 85*a* and a sub-electrode portion 86*a*. Similarly, the sustaining electrode 83*b* includes a main electrode portion 85*b* and a sub-electrode portion 86*b*.

Both of the main electrode portion 85*a* and the main electrode portion 85*b* are made up of transparent conductive thin films in stripe shapes such as tin oxide, indium oxide, or ITO (Indium Tin Oxide). Widths of the main electrode portion 85*a* and the main electrode portion 85*b* are 30 $\mu$m to 100 $\mu$m, preferably, 40 $\mu$m to 80 $\mu$m. A plurality of pairs of sub-electrode portions 86*a* and sub-electrode portions 86*b* are formed at under layers of the main electrode portion 85*a* and the main electrode portion 85*b* so as to correspond with the main electrode portion 85*a* and the main electrode portion 85*b*. The sub-electrode portion 86*a* is made up of a metal film such as thick film of silver, and a thin film of aluminum, copper or a like, and is provided with a parallel portion $\mathbf{87}_1$, a plurality of vertical portions $\mathbf{87}_2$ provided on a division wall 13, and a plurality of cross parts $\mathbf{87}_3$ provided for each display cell 12. The parallel portion $\mathbf{87}_1$ is formed in parallel with the main electrode portion 85*a* at a predetermined distance from the main electrode portion 85*a* so as to extend in the row direction. Each vertical portion $\mathbf{87}_2$ is integrated with the parallel portion $\mathbf{87}_1$ and extends in the column direction perpendicular to the parallel portion $\mathbf{87}_1$ and to the main electrode portion 85*a* over the division wall 13. an upper face end portion of each vertical portion $87_2$ is electrically in contact with the lower face of the main electrode portion 85*a*. Each cross part $87_3$ is integrated with the parallel portion $87_1$ is formed over a position at which distances from adjacent division wall 13 in the display cell 12 in an area surrounded by a dashed line in FIG. 5 are approximately equal. Each cross part $87_3$ is provided with a vertical portion $87_{3a}$ and a parallel portion $87_{3b}$. The vertical portion $87_{3a}$ extends to the main electrode 85*a* in the column direction perpendicular to the parallel portion $87_{3b}$. A top of the vertical portion $87_{3a}$ reaches near a side face opposite to the side facing the discharge gap 84 of the main electrode portion 85*a*. The parallel portion $87_{3b}$ extends from an approximate center to two adjacent vertical portions $87_2$ in the row direction and reaches near the side of the vertical portion $87_2$. Similarly, the sub-electrode portion 86*b* is made up of metal films such as thick films of silver, or thin films of aluminum or copper and is provided with a first parallel portion $88_1$, a plurality of vertical portions $88_2$ formed on the division wall 13, a plurality of cross parts $88_3$ formed for respective display cells 12. The sub-electrode portion 86*a* and the sub-electrode portion 86*b* are in a line-ymmetric relationship in which a center axis of the discharge gap 84 is used as a symmetry line, and therefore, no detailed explanations of the sub-electrode portion 86*b* will be given.

Widths of the parallel portion $87_1$ and the parallel portion $88_1$ are preferably 30 μm to 60 μm to reduce resistance values of the main electrode portion 85*a* and the main electrode portion 85*b* of which conductivity is low. In other words, the parallel portion $87_1$ and the first parallel portion $88_1$ function similarly to conventional bus electrodes. It is preferable that widths of the vertical portion $87_2$ and the vertical portion $88_2$ are equal to the width of the division wall 13 or narrower than the width of the division wall 13 from points of luminous efficiency and luminance. And, it is preferable that widths of the vertical portion $87_2$ and the vertical portion $88_2$ are a half of the width of the division wall 13 or less from points of manufacturing. Widths of the cross part $87_3$ and the cross part $88_3$ are 1 μm to 50 μm, preferably, 1 μm to 30 μm. In the fourth embodiment, both of an interval between the main electrode portion 85*a* and the parallel portion $87_1$, and an interval between the main electrode portion 85*b* and the parallel portion $88_1$ are 60 μm to 280 μm.

Additionally, the main electrode portion 85*a* and the main electrode portion 85*b*, the sub-electrode portion 86*a* and the sub-electrode portion 86*b*, and a dielectric layer and a protection layer (both not shown) which may be sequentially formed on a lower face of the front insulation substrate 82 (not shown) on which no main electrode portion 85*a* and no main electrode portion 85*b*, and no sub-electrode portion 86*a* and no sub-electrode portion 86*b* are formed are similar to those of the conventional PDP, and therefore, no explanations of those will be given. Also, a data electrode, a dielectric layer, a division wall, and three kinds of fluorescent layers (all not shown) which are sequentially formed on a back insulation substrate (not shown), and discharge gas to be filled up in a discharge gas space (not shown) are similar to those of a conventional PDP, and therefore, no explanations of those will be given. Also, a method of forming the sustaining electrode 83*a* and the sustaining electrode 83*b* included in the PDP 81 is approximately similar to that of the first embodiment except that a pattern shape in patterning a photosensitive dry film 41 (shown in FIG. 2A) and photosensitive silver paste 43 (shown in FIG. 2E) since shapes of the sub-electrode portion 86*a* and the sub-electrode 86*b* are different from those of a sub-electrode portion 36*a* (shown in FIG. 1) and a sub-electrode portion 36*b* (shown in FIG. 1). Therefore, no explanations of the method will be given.

As described above, with the fourth embodiment, differently from the second embodiment, as to the cross part $87_3$, the upper face of the end portion of the vertical portion $87_{3a}$ is not electrically in contact with the lower face of the main electrode 85*a*, and the end portion of the vertical portion $87_{3a}$ is not electrically contact with the side of the adjacent vertical portion $87_2$. Therefore, according to the structure of the fourth embodiment, since it is possible to reduce an area of metal film which is not transparent and intercepts visible lights in comparison with the second embodiment, it is possible to make luminance higher and to improve luminous efficiency more.

Fifth Embodiment

A fifth embodiment of the present invention will be described.

Figure 6:
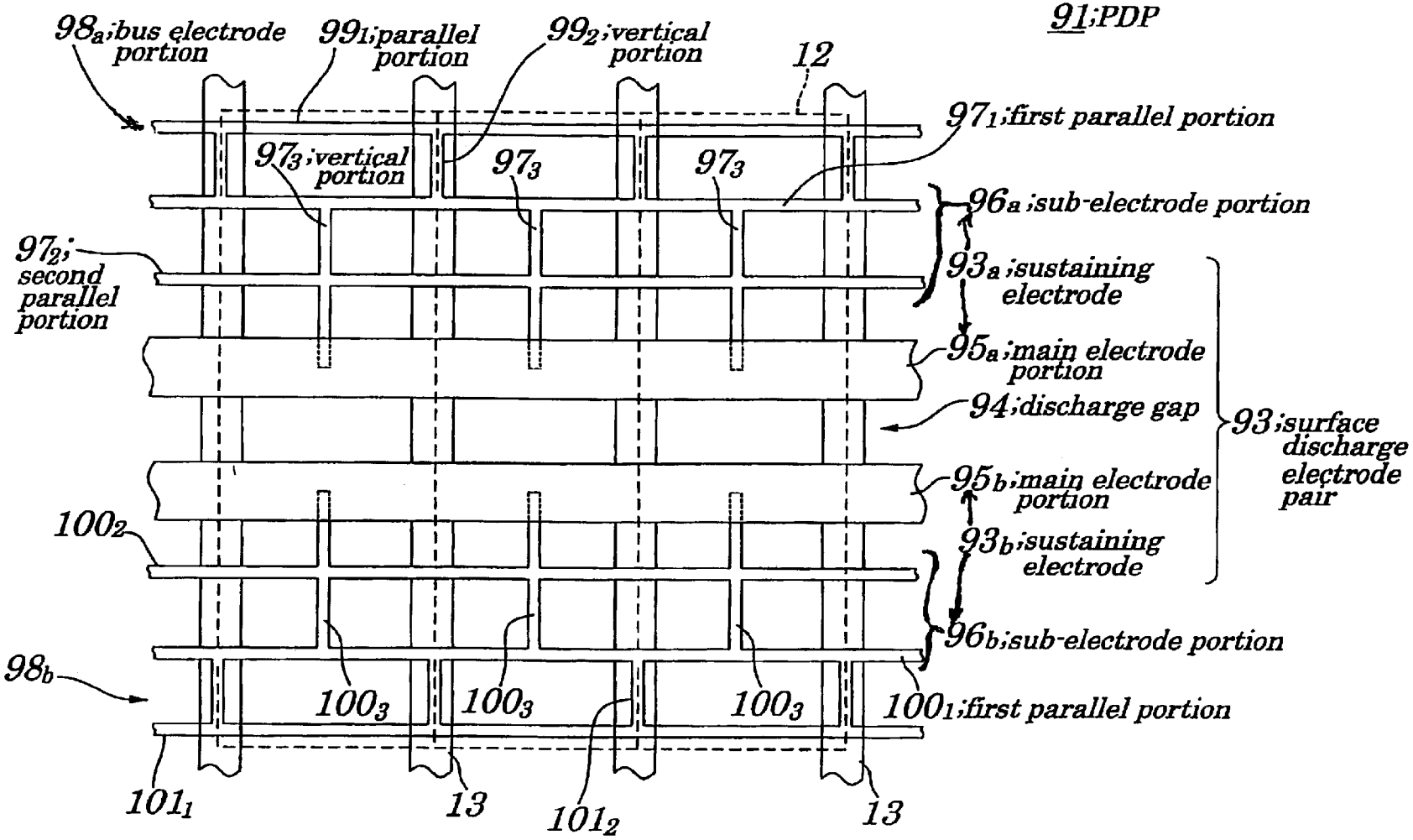
FIG. 6 is a top view showing an AC driving surface discharge type of PDP 91 in that a front insulation substrate 92 is not shown, according to a fifth embodiment of the present invention.
Figure 7:
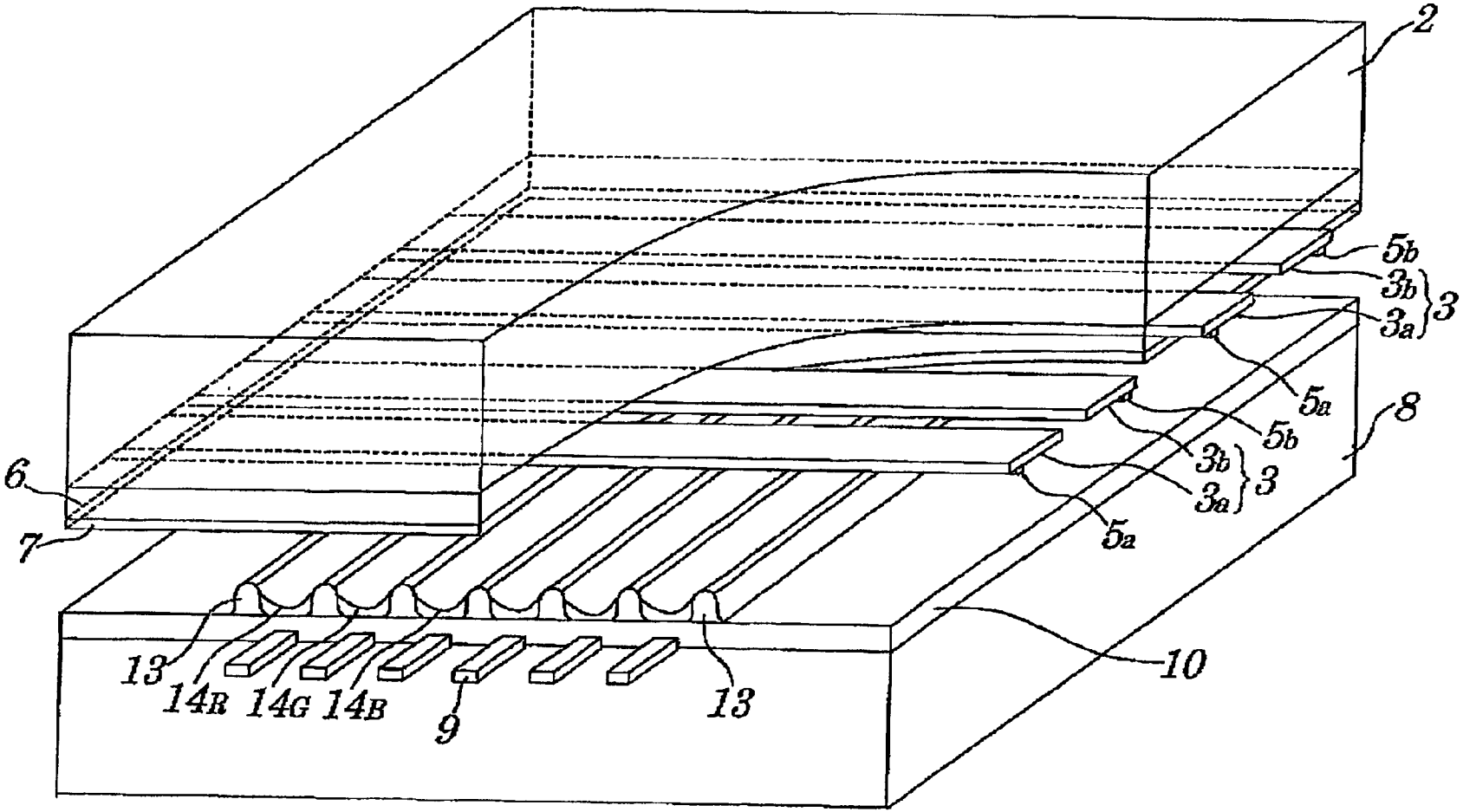
FIG. 7(PRIOR ART)
FIG. 7 is a perspective exploded view showing a schematic structure of a conventional AC driving surface discharge type of PDP 1 in that a part of a front insulation substrate 2 is cut out.
Figure 8:
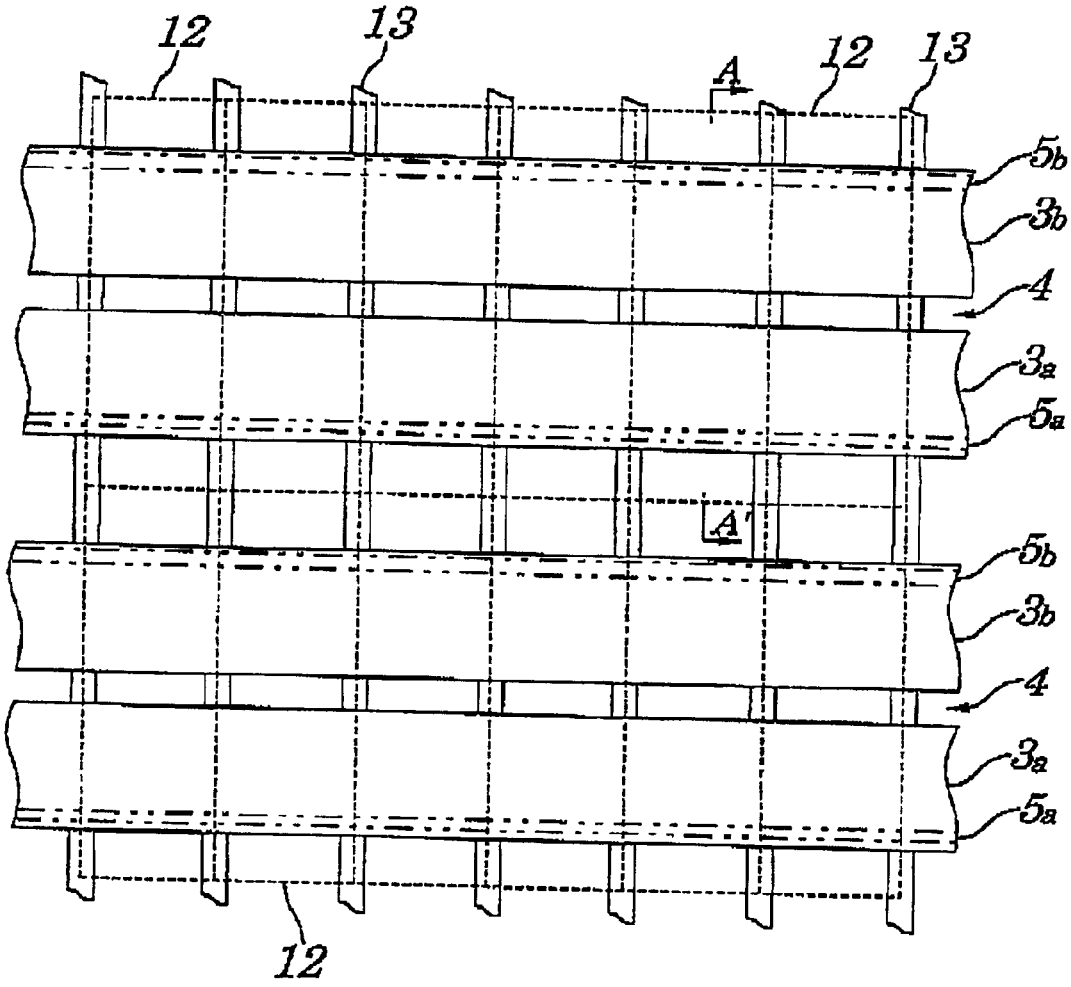
FIG.8 (PRIOR ART)
FIG. 8 is a top view showing the conventional AC driving surface discharge type of PDP 1 in that the front insulation substrate 2 is not shown.
Figure 9:
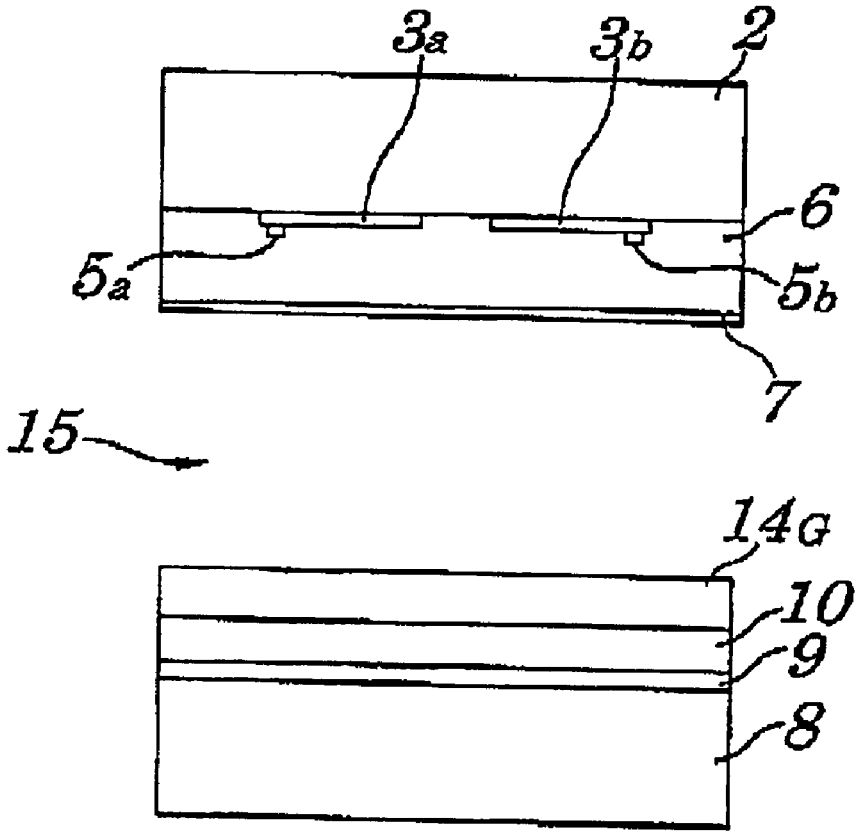
FIG.9(PRIOR ART)
FIG. 9 is an enlarged sectional view showing a section taken along a line A-A' in FIG. 8.
Figure 10A:
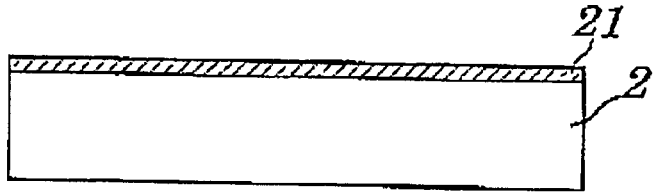
FIG.10A (PRIOR ART)
FIG. 10A to FIG. 10E are conventional process views for explaining a method of forming a sustaining electrode 3*a*, a sustaining electrode 3*b*, a bus electrode 5*a*, and a bus electrode 5*b* of the PDP 1.
Figure 10B:
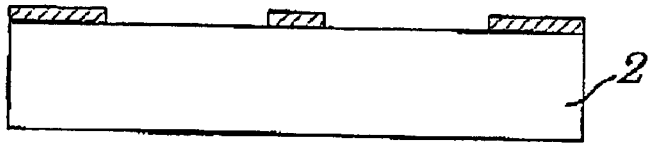
FIG.10B (PRIOR ART)
Figure 10C:
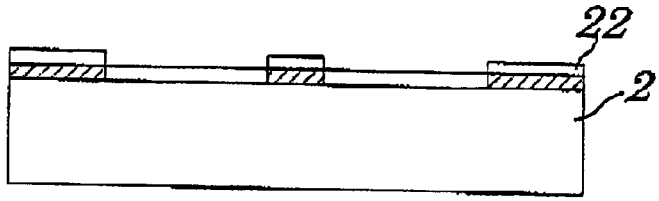
FIG.10C (PRIOR ART)
Figure 10D:
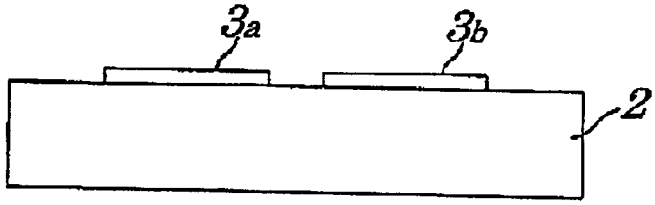
FIG.10D (PRIOR ART)
Figure 10E:
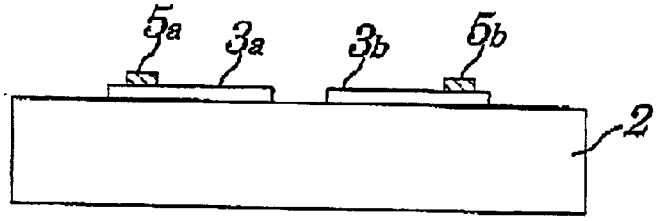
FIG.10E (PRIOR ART)

FIG. 6 is a top view showing an AC driving surface discharge type of PDP 91 in that a front insulation substrate 92 is not shown, according to a fifth embodiment of the present invention.

In the PDP 91, under the front insulation substrate 92 (not shown), as shown in FIG. 6, a plurality of pairs of sustaining electrodes 93*a* and sustaining electrodes 93*b* extending in a row direction (in a horizontal direction in FIG. 6) as whole are alternately arranged in a column direction (in a vertical direction in FIG. 6) at predetermined intervals so that a discharge gap 94 is put between each pair. The front insulation substrate 92 (not shown) is made of soda lime glass or a like so as to have a thickness of 2 mm to 5 mm. The sustaining electrode 93*a* and the sustaining electrode 93*b* form a surface discharge electrode pair 93. The sustaining electrode 93*a* includes a main electrode portion 95*a* and a sub-electrode portion 96*a*. Similarly, the sustaining electrode 93*b* includes a main electrode portion 95*b* and a sub-electrode portion 96*b*.

Both of the main electrode portion 95*a* and the main electrode portion 95*b* are made up of transparent conductive thin films in stripe shapes such as tin oxide, indium oxide, or ITO (Indium Tin Oxide). Widths of the main electrode portion 95*a* and the main electrode portion 95*b* are 30 μm to 100 μm, preferably, 40 μm to 80 μm. A plurality of pairs of sub-electrode portions 96*a* and sub-electrode portions 96*b* and a plurality of pairs of bus electrode portions 98*a* and bus electrode portions 98*b* are formed at under layers of the main electrode portion 95*a* and the main electrode portion 95*b* so as to correspond the main electrode portion 95*a* and the main electrode portion 95*b*. The sub-electrode 96*a* is made up of a metal film such as thick film of silver, and a thin film of aluminum, copper or a like, and is provided with a first parallel portion $97_1$, a second parallel portion $97_2$, a plurality of vertical portions $97_3$ provided for each display cell 12. The first parallel portion $97_1$ is formed in parallel with the main electrode portion 95*a* at a predetermined distance from the main electrode portion 95*a* so as to extend in the row direction. The second parallel portion $97_2$ is formed between the main electrode portion 95*a* and the first parallel portion $97_1$ in parallel with the main electrode portion 95*a* at a predetermined distance from the main electrode portion 95*a* so as to extend in the row direction. Each vertical portion $97_3$ is integrated with the first parallel portion $97_1$ and the second parallel portion $97_2$, and extends in the column direction perpendicular to the first parallel portion $97_1$ and the second parallel portion $97_2$. Each top of the vertical portion $97_3$ is electrically in contact with the lower face of the main electrode portion 95*a*. Each vertical portion $97_3$ is formed over a position at which distances from adjacent division walls 13 in the display cell 12 in an area surrounded by a dashed line in FIG. 6 are approximately equal. Also, the bus electrode portion 98*a* is made up of a metal film such as thick film of silver, and a thin film of aluminum, copper or a like, is integrated with the sub-electrode portion 96*a*, and is provided with a parallel portion $\mathbf{99}_1$, and a plurality of vertical portions $\mathbf{99}_2$ provided over the division wall 13. The parallel portion $\mathbf{99}_1$ is formed in parallel with the first parallel portion $\mathbf{97}_1$ at a predetermined distance from the first parallel portion $\mathbf{97}_1$ as not to be influenced by the discharge and so as to extend in the row direction. Each vertical portion $\mathbf{99}_3$ is integrated with the first parallel portion $\mathbf{97}_1$, the second parallel portion $\mathbf{97}_2$, and the parallel portion $\mathbf{99}_1$ and extends in the column direction perpendicular to the first parallel portion $\mathbf{97}_1$, the second parallel portion $\mathbf{97}_2$ and the parallel portion $\mathbf{99}_1$, an upper face of an end portion of each vertical portion $\mathbf{97}_3$ is electrically in contact with the lower face of the first parallel portion $\mathbf{97}_1$. Similarly, the sub-electrode portion 96*b* is made up of metal films such as thick films of silver, or thin films of aluminum or copper and is provided with a first parallel portion $\mathbf{100}_1$, a second parallel portion $\mathbf{100}_2$, a plurality of vertical portions $\mathbf{100}_3$ formed for respective display cells 12. Also, the bus electrode portion 98*b* is made up of metal films such as thick films of silver, or thin films of aluminum or copper, is integrated with the sub-electrode portion 96*b* and is provided with a parallel portion $\mathbf{101}_1$, and a plurality of vertical portions $\mathbf{101}_2$ formed over the division wall 13. The sub-electrode portion 96*a* and the sub-electrode portion 96*b* are in a line-ymmetric relationship in which a center axis of the discharge gap 94 is used as a symmetry line, and therefore, no detailed explanations of the sub-electrode portion 96*b* will given. Similarly, the bus electrode portion 98*a* and the bus electrode portion 98*b* are in a line-ymmetric relationship in which a center axis of the discharge gap 94 is used as a symmetry line, and therefore, no detailed explanations of the bus-electrode portion 96*b* will given.

Widths of the first parallel portion $\mathbf{97}_1$ and the first parallel portion $\mathbf{100}_1$, widths of the second parallel portion $\mathbf{97}_2$ and the second parallel portion $\mathbf{100}_2$, widths of the vertical portion $\mathbf{97}_3$ and the vertical portion $\mathbf{100}_3$ are 1 $\mu$m to 50 $\mu$m, preferably, 1 $\mu$m to 30 $\mu$m. In the fifth embodiment, both of an interval between the main electrode portion 95*a* and the second parallel portion $\mathbf{97}_2$, and an interval between the second parallel portion $\mathbf{97}_2$ and the first parallel portion $\mathbf{97}_1$ are 30 $\mu$m to 140 $\mu$m. Similarly, both of an interval between the main electrode portion 95*b* and the second parallel portion $\mathbf{100}_2$, and an interval between the second parallel portion $\mathbf{100}_2$ and the first parallel portion $\mathbf{100}_1$ are 30 $\mu$m to 140 $\mu$m. Also, both of an interval between the parallel portion $\mathbf{99}_1$ and the parallel portion $\mathbf{100}_2$, forming the bus electrode portion 98*a* and the bus electrode portion 98*b* are preferably 30 $\mu$m to 60 $\mu$m to reduce the resistance values of the main electrode portion 95*a* and the main electrode portion 95*b* of which conductivity is low.

Additionally, the main electrode portion 95*a* and the main electrode portion 95*b*, the sub-electrode portion 96*a* and the sub-electrode portion 96*b*, the bus electrode portion 98*a* and the bus electrode portion 98*b*, and a dielectric layer (not shown) and a protection layer (not shown) which may be sequentially formed on a lower face of the front insulation substrate 92 (not shown) on which no main electrode portion 95*a* and no main electrode portion 95*b*, no sub-electrode portion 96*a* and no sub-electrode portion 96*b*, and no bus electrode portion 98*a* and no bus electrode portion 98*b* are formed are similar to those of a conventional PDP, and therefore, no explanations of those will be given. Also, a data electrode, a dielectric layer, a division wall, and three kinds of fluorescent layers (all not shown) which are sequentially formed on the back insulation substrate (not shown), and discharge gas to be filled up in a discharge gas space (not shown) are similar to those of the conventional PDP, and therefore, no explanations of those will be given. Also, a method of forming the sustaining electrode 93*a* and the sustaining electrode 93*b* and the bus electrode portion 98*a* and the bus electrode portion 98*b* included in the PDP 91 is approximately similar to that of the first embodiment except that a pattern shape in patterning of a photosensitive silver paste 43 (shown in FIG. 2E) since shapes of the sub-electrode portion 96*a* and the sub-electrode 96*b* are different from those of the sub-electrode portion 36*a* (shown in FIG. 1) and the sub-electrode portion 36*b* (shown in FIG. 1) and the bus electrode portion 98*a* and the bus electrode portion 98*b* are provided. Therefore, no explanations of the method will be given.

As described above, with the configuration of the fifth embodiment, since the bus electrode portion 98*a* and the bus electrode portion 98*b* are provided, the following effects can be obtained in addition to those of the first embodiment. Since the resistance values of the main electrode portion 95*a* and the main electrode portion 95*b* of which each conductivity is low are reduced by the parallel portion $\mathbf{99}_1$ and the parallel portion $\mathbf{100}_1$ included in the bus electrode portion 98*a* and the bus electrode portion 98*b*, it is unnecessary to reduce the resistance values by the first parallel portion $\mathbf{97}_1$ and the first parallel portion $\mathbf{100}_1$. With this structure, it is unnecessary to make the widths of the first parallel portion $\mathbf{97}_1$ and the first parallel portion $\mathbf{100}_1$ larger to diffuse the discharge into the first parallel portion $\mathbf{97}_1$ and the first parallel portion $\mathbf{100}_1$. Therefore, since it is possible to reduce the area of metal film which is not transparent and intercepts visible lights in comparison with the first embodiment, it is possible to make luminance higher and to improve luminous efficiency more.

It is thus apparent that the present invention is not limited to the above embodiments but may be changed and modified without departing from the scope and spirit of the invention.

For example, the first embodiment, as shown in FIG. 2A to FIG. 2F, shows the method in which the sub-electrode portion 36*a* and the sub-electrode portion 36*b* are formed after the main electrode portion 35*a* and the main electrode portion 35*b* are formed. The present invention is not limited to this, and the main electrode portion 35*a* and the main electrode portion 35*b* may be formed after the sub-electrode portion 36*a* and the sub-electrode portion 36*b* are formed. Other embodiments are similar to this.

Also, the first embodiment shows the method in which the sub-electrode portion 36*a* and the sub-electrode portion 36*b* are formed by patterning the photosensitive silver paste 43. However, the present invention is not limited to this, and the sub-electrode portion 36*a* and the sub-electrode portion 36*b* (both shown in FIG. 1) may be formed by annealing after patterning the photosensitive silver paste 43 (shown in FIG. 2E). Other embodiments are similar to this. When the sub-electrode portion 36*a* and the sub-electrode portion 36*b* are formed by patterning of the photosensitive silver paste 43, there are advantages in that the process can be made simpler than and use rate of materials can be more improved than a case in which the sub-electrode portion 36*a* and the sub-electrode portion 36*b* are formed by patterning the photosensitive silver paste 43.

Also, if only there is no discrepancy in the object and the structures, all embodiments can be diverted one another. For example, the bus electrode portion 98*a* and the bus electrode portion 98*b* may be integrated with sub-electrode portions in another embodiment.

What is claimed is:

1. A plasma display panel comprising:

plural surface discharge electrode pairs extending in a first direction at predetermined intervals from each other, each of said plural surface discharge electrode pairs comprising a pair of sustaining electrodes with a discharge gap therebetween, each of said sustaining electrodes comprising, a stripe-shaped main electrode that is a transparent conductive thin film and that has a first side facing the discharge gap, and a sub-electrode that is a metal film electrically connected to said main electrode, said sub-electrode having a width narrower than a width of said main electrode, said sub-electrode being spaced from said main electrode at a second side of said main electrode opposite the first side.

2. The panel of claim 1, wherein said sub-electrode comprises a first portion parallel to and spaced from said main electrode and a second portion parallel to said first portion, said second portion being between and spaced from said first portion and said main electrode.

3. The panel of claim 2, wherein said sub-electrode further comprises a third portion that extends from said first portion to said main electrode and that electrically connects said first and second portions to each other and to said main electrode.

4. The panel of claim 3, further comprising a pair of divisional walls extending in a second direction perpendicular to the first direction, a space between said divisional walls defining a display cell, and wherein said third portion extends in the second direction and bisects the space between said divisional walls.

5. The panel of claim 4, wherein said sub-electrode further comprises a fourth portion that extends in the second direction from said first portion to said main electrode and that electrically connects said first and second portions to each other and to said main electrode, and wherein said fourth portion is aligned with one of said divisional walls.

6. The panel of claim 5, wherein said fourth portion has a width no wider than a width of the one of said divisional walls with which said fourth portion is aligned.

7. The panel of claim 5, wherein said fourth portion has a width no wider than one half a width of the one of said divisional walls with which said fourth portion is aligned.

8. The panel of claim 2, wherein said second portion has a width of 1 $\mu$m to 50 $\mu$m.

9. The panel of claim 2, wherein said second portion has a width of 1 $\mu$m to 30 $\mu$m.

10. The panel of claim 3, wherein said third portion has a width of 1 $\mu$m to 50 $\mu$m.

11. The panel of claim 3, wherein said third portion has a width of 1 $\mu$m to 30 $\mu$m.

12. The panel of claim 3, wherein said main electrode has a projection extending from the second side and wherein said third portion is connected to said projection.

13. The panel of claim 12, further comprising a pair of divisional walls extending in a second direction perpendicular to the first direction, a space between said divisional walls defining a display cell, wherein said third portion extends in the second direction and bisects the space between said divisional walls, and wherein said projection is midway between said divisional walls.

14. The panel of claim 12, wherein said projection has a length of 30 $\mu$m to 60 $\mu$m and a width of 30 $\mu$m to 60 $\mu$m.

15. The panel of claim 1, wherein said sub-electrode comprises a first portion parallel to and spaced from said main electrode, a second portion that extends from said first portion to said main electrode and connects said first portion to said main electrode, and a third portion connected to said first portion and separated from said second portion and from said main electrode, said portion having a first cross piece that extends toward said main electrode and a second cross piece that crosses said first cross piece and is parallel to said first portion.

16. The panel of claim 15, further comprising a pair of divisional walls extending in a second direction perpendicular to the first direction, a space between said divisional walls defining a display cell, wherein said first cross piece extends in the second direction and bisects the space between said divisional walls and wherein said second portion is aligned with one of said divisional walls.

17. The panel of claim 16, wherein said second portion has a width no wider than a width of the one of said divisional walls with which said second portion is aligned.

18. The panel of claim 16, wherein said second portion has a width no wider than one half a width of the one of said divisional walls with which said second portion is aligned.

19. The panel of claim 2, further comprising a bus electrode with a first bus electrode part that is parallel to and spaced from said first portion on a side of said first portion opposite said second portion and a second bus electrode part that connects said first bus electrode part to said first portion.

20. The panel of claim 1, wherein said main electrode has a width of 30 $\mu$m to 100 $\mu$m.

21. The panel of claim 1, wherein said main electrode has a width of 40 $\mu$m to 80 $\mu$m.

22. The panel of claim 12, wherein said first portion and said second portion each have a width of 30 $\mu$m to 100 $\mu$m.

23. The panel of claim 12, wherein said first portion and said second portion each have a width of 40 $\mu$m to 80 $\mu$m.

24. The panel of claim 2, wherein said first portion has a width of 30 $\mu$m to 60 $\mu$m.

25. The panel of claim 2, wherein a space between said main electrode and said first portion is 30 $\mu$m to 140 $\mu$m and wherein a space between said second portion and said first portion is 30 $\mu$m to 140 $\mu$m.

26. A method of making a plasma display panel, comprising the steps of:

forming on a substrate plural surface discharge electrode pairs extending in first direction at predetermined intervals from each other, each of the plural surface discharge electrode pairs having a pair of sustaining electrodes with a discharge gap therebetween, each of the sustaning electrodes having a stripe-shaped main electrode that is a transparent conductive thin film and that has a first side facing the discharge gap;

coating photo-sensitive silver paste on the substrate; and exposing and developing the photosensitive silver paste, patterning the developed silver paste, and annealing the patterned silver paste to form a sub-electrode that is electrically connected to the main electrode, the sub-electrode having a width narrower than a width of the main electrode the sub-electrode being spaced from the main electrode at a second side of the main electrode opposite the first side.

27. A method of making a plasma display panel, comprising the steps of:

forming on a substrate plural surface discharge electrode pairs extending in a first direction at predetermined intervals from each other, each of the plural surface discharge electrode pairs having a pair of sustaining electrodes with a discharge gap therebetween, each of the sustaining electrodes having a striped-shaped main electrode that is transparent conductive thin film and that has a first side facing the discharge gap;

coating silver paste on the substrate; and patterning the silver paste and annealing the patterned silver paste to form a sub-electrode that is electrically connected to the main electrode, the sub-electrode having a width narrower than a width of the main electrode, the sub-electrode being spaced from the main electrode at a second side of the main electrode opposite the first side.

* * * * *